US009291018B2

(12) United States Patent
Korn, Jr. et al.

(10) Patent No.: US 9,291,018 B2
(45) Date of Patent: Mar. 22, 2016

(54) SYSTEMS AND METHODS TO INHIBIT PACKOFF EVENTS DURING DOWNHOLE ASSEMBLY MOTION WITHIN A WELLBORE

(71) Applicants: Lillard Eugene Korn, Jr., Cypress, TX (US); Pietro Valsecchi, Houston, TX (US)

(72) Inventors: Lillard Eugene Korn, Jr., Cypress, TX (US); Pietro Valsecchi, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 567 days.

(21) Appl. No.: 13/717,150

(22) Filed: Dec. 17, 2012

(65) Prior Publication Data

US 2013/0153235 A1 Jun. 20, 2013

Related U.S. Application Data

(60) Provisional application No. 61/578,078, filed on Dec. 20, 2011.

(51) Int. Cl.

| | |
|---|---|
| ***E21B 31/03*** | (2006.01) |
| ***E21B 23/04*** | (2006.01) |
| ***E21B 21/00*** | (2006.01) |
| ***E21B 41/00*** | (2006.01) |
| ***E21B 21/10*** | (2006.01) |
| *E21B 31/107* | (2006.01) |

(52) U.S. Cl.

CPC ..... *E21B 31/03* (2013.01); *E21B 21/00* (2013.01); *E21B 21/10* (2013.01); *E21B 23/04* (2013.01); *E21B 41/0078* (2013.01); *E21B 31/107* (2013.01)

(58) Field of Classification Search

CPC ..... E21B 10/38; E21B 21/00; E21B 21/002; E21B 21/10; E21B 21/12; E21B 23/04; E21B 31/03; E21B 31/107; E21B 31/113; E21B 31/1135; E21B 41/0078; E21B 7/00

See application file for complete search history.

(56) References Cited

U.S. PATENT DOCUMENTS

| | | | | |
|---|---|---|---|---|
| 2,833,517 | A | 5/1958 | Bobo | |
| 3,912,173 | A * | 10/1975 | Robichaux | 239/443 |
| 4,373,582 | A | 2/1983 | Bednar et al. | |
| 4,844,182 | A | 7/1989 | Tolle | |
| 4,909,325 | A * | 3/1990 | Hopmann | 166/312 |
| 5,056,609 | A * | 10/1991 | Rear | 175/296 |
| 5,074,366 | A | 12/1991 | Karlsson et al. | |
| 5,465,787 | A | 11/1995 | Roth | |
| 5,730,222 | A | 3/1998 | Rike, Jr. | |

(Continued)

FOREIGN PATENT DOCUMENTS

| | | |
|---|---|---|
| CA | 1 253 846 | 5/1989 |
| WO | WO 02/14649 A1 | 2/2002 |

*Primary Examiner* — Robert E Fuller
*Assistant Examiner* — Christopher Sebesta
(74) *Attorney, Agent, or Firm* — ExxonMobil Upstream Research-Law Department

(57) ABSTRACT

Systems and methods to inhibit packoff events during downhole assembly motion within a wellbore comprise a downhole assembly that includes an energy-storing structure that defines a charged state and a discharged state and is configured to generate a motive force upon transitioning from the charged state to the discharged state. A fluidizing stream is generated with the motive force from the energy-storing structure which emits the fluidizing stream from the downhole assembly to fluidize a portion of a cuttings bed that may be within the wellbore and proximal to the downhole assembly.

19 Claims, 13 Drawing Sheets

(56) References Cited

U.S. PATENT DOCUMENTS

| | | | | |
|---|---|---|---|---|
| 5,979,572 | A | 11/1999 | Boyd et al. | |
| 5,984,011 | A | 11/1999 | Misselbrook et al. | |
| 6,290,001 | B1 | 9/2001 | West et al. | |
| 6,820,702 | B2 | 11/2004 | Niedermayr et al. | |
| 6,868,920 | B2 | 3/2005 | Hoteit et al. | |
| 7,003,439 | B2 | 2/2006 | Aldred et al. | |
| 7,114,582 | B2 | 10/2006 | Eppink et al. | |
| 7,653,563 | B2 | 1/2010 | Veeningen et al. | |
| 7,703,549 | B2 | 4/2010 | Krepp et al. | |
| 7,814,989 | B2 | 10/2010 | Nikolakis-Mouchas et al. | |
| 2004/0112645 | A1* | 6/2004 | Eppink et al. | 175/61 |
| 2008/0060846 | A1 | 3/2008 | Belcher et al. | |
| 2009/0078466 | A1* | 3/2009 | Luo | 175/171 |
| 2009/0133883 | A1 | 5/2009 | Baird | |
| 2009/0145661 | A1 | 6/2009 | Jeffryes et al. | |
| 2010/0235101 | A1 | 9/2010 | Aamodt et al. | |
| 2010/0294569 | A1* | 11/2010 | Aldred et al. | 175/65 |
| 2012/0059521 | A1 | 3/2012 | Iversen et al. | |

* cited by examiner

SYSTEMS AND METHODS TO INHIBIT PACKOFF EVENTS DURING DOWNHOLE ASSEMBLY MOTION WITHIN A WELLBORE

CROSS REFERENCE TO RELATED APPLICATIONS

This application claims the benefit of U.S. Provisional Application 61/578,078, filed Dec. 20, 2011.

FIELD OF THE DISCLOSURE

The present disclosure is directed generally to systems and methods to inhibit packoff events when a downhole assembly is moved within a wellbore and more specifically to systems and methods that fluidize a portion of a cuttings bed to inhibit packoff events.

BACKGROUND OF THE DISCLOSURE

The production of fluids from subterranean formations may utilize subterranean wells to transport the fluids from the subterranean formation to a surface region and/or to provide stimulant fluids to the subterranean formation. These subterranean wells may be created using a downhole assembly, such as a drilling assembly, to drill a wellbore, which may form a portion of the subterranean well. Drilling assemblies may include a plurality of portions, regions, components, parts, segments, and/or sections, each of which may serve a specific purpose during creation of the wellbore. These sections may include a cross-sectional area, and this cross-sectional area may vary from section to section and/or within individual sections.

As an illustrative, non-exclusive example, the downhole assembly may include a drill pipe and a bottom-hole assembly. The drill pipe typically will form a mechanical and fluid connection between the surface region and the bottom-hole assembly. In addition, a cross-sectional area and/or a diameter of the drill pipe may be less than a cross-sectional area and/or diameter of the bottom-hole assembly.

During a drilling process, the bottom-hole assembly, which may include a drill bit, may be in at least temporary mechanical contact with a terminal end of the wellbore and may remove material, which may be referred to herein as cuttings, from the terminal end of the wellbore to increase a length of the wellbore. The downhole assembly also may include a drilling fluid conduit that is configured to provide a drilling fluid stream to the wellbore, such as to the terminal end thereof, via the bottom-hole assembly. The drilling fluid stream may lubricate at least a portion of the bottom-hole assembly, cool at least a portion of the bottom-hole assembly, and/or provide a motive force for removal of at least a portion of the cuttings from the wellbore by flowing the cuttings to the surface region via an annular space that is present between the downhole assembly and the wellbore.

However, a portion of the cuttings may remain within the wellbore. These cuttings may settle and/or otherwise accumulate and may produce a cuttings bed on and/or near a bottom surface of the wellbore. The size, or extent, of this cuttings bed, or, alternatively, a fraction of the cuttings that remain within the wellbore to form the cuttings bed, may vary with a variety of factors. Illustrative, non-exclusive examples of such factors may include a flow rate of the drilling fluid stream, a diameter of the wellbore, a diameter of the downhole assembly, a size of the cuttings, a density of the cuttings, a viscosity of the drilling fluid, and/or an orientation of the wellbore.

As an illustrative, non-exclusive example, a horizontal, substantially horizontal, and/or highly inclined wellbore may include a larger cuttings bed than a vertical, or substantially vertical, wellbore. This may be caused, at least in part, by a tendency for the cuttings to settle under the influence of gravity to the bottom, or other horizontal, substantially horizontal, and/or highly inclined (i.e., away from a vertical orientation) surface of the wellbore and/or a tendency for the drilling fluid to flow, or channel, near an upper surface of the wellbore. As another illustrative, non-exclusive example, a wellbore that includes a breakout region, wherein a cross-sectional area of the wellbore is greater than a nominal cross-sectional area of the wellbore, may include a larger cuttings bed in the vicinity of the breakout region. This may be caused by a decrease in the flow rate of the drilling fluid stream within the breakout region due to the larger cross-sectional area of the wellbore in the breakout region.

During and/or after completion of the drilling process, at least a portion of the downhole assembly may be withdrawn from, drawn out of, pulled from, taken out of, removed from and/or otherwise moved within the wellbore. This motion may include drawing, pulling, and/or pushing the downhole assembly within the wellbore and along a longitudinal axis of the downhole assembly, such as toward the surface region and/or toward the terminal end of the wellbore. In conjunction with pulling and/or pushing, the downhole assembly may be rotated and/or drilling fluid may be circulated through the drill pipe, the bottom hole assembly, and/or the drill bit and up the annular space. Motion of the downhole assembly within the wellbore may push, move, collect, and/or otherwise accumulate at least a portion of the cuttings bed present within the wellbore, leading to the formation of a cuttings dune. As an illustrative, non-exclusive example, a transition region between a first section of the downhole assembly, which includes a first cross-sectional area, and a second section of the downhole assembly, which includes a second cross-sectional area that is larger than the first cross-sectional area, may facilitate, or otherwise contribute to, formation of a cuttings dune.

Under certain circumstances, the cuttings dune may generate a packoff event, which may preclude further motion of the downhole assembly within the wellbore. The occurrence of the packoff event may result in abandonment of at least a portion of the wellbore, require drilling a new section of the wellbore adjacent to the location of the packoff event, and/or result in abandonment of the bottom-hole assembly in the wellbore, any of which may substantially increase the costs associated with, and/or time needed to complete, the drilling operation.

SUMMARY OF THE DISCLOSURE

Systems and methods to inhibit packoff events during downhole assembly motion within a wellbore. The systems and methods include a downhole assembly that includes an energy-storing structure that defines a charged state and a discharged state and which is configured to generate a motive force by transitioning from the charged state to the discharged state. The systems and methods further include generating a fluidizing stream with the motive force from the energy-storing structure and emitting the fluidizing stream from the downhole assembly to fluidize a portion of a cuttings bed that may be within the wellbore and proximal to the downhole assembly.

In some embodiments, the systems and methods further may include conveying the downhole assembly within the wellbore. In some embodiments, the conveying may include generating an axial force within a portion of the downhole assembly. In some embodiments, the discharging may include discharging responsive to the axial force exceeding a threshold axial force.

In some embodiments, the generating may include generating the fluidizing stream with a fluid propulsion device. In some embodiments, the fluid propulsion device may be configured to receive the motive force from the energy-storing structure and to generate the fluidizing stream responsive to and/or during receipt of the motive force. In some embodiments, the fluid propulsion device includes a fluid reservoir that defines an expanded state and a contracted state. In some embodiments, the generating may include contracting the fluid reservoir by transitioning the fluid reservoir from the expanded state toward and/or to the contracted state to generate the fluidizing stream.

In some embodiments, the emitting may include emitting the fluidizing stream with and/or through a fluidizing assembly. In some embodiments, the emitting may include emitting the fluidizing stream in a transition region between a first section of the downhole assembly and a second section of the downhole assembly that has a cross-sectional area that is greater than the cross-sectional area of the first section.

DETAILED DESCRIPTION AND BEST MODE OF THE DISCLOSURE

Figure 1:
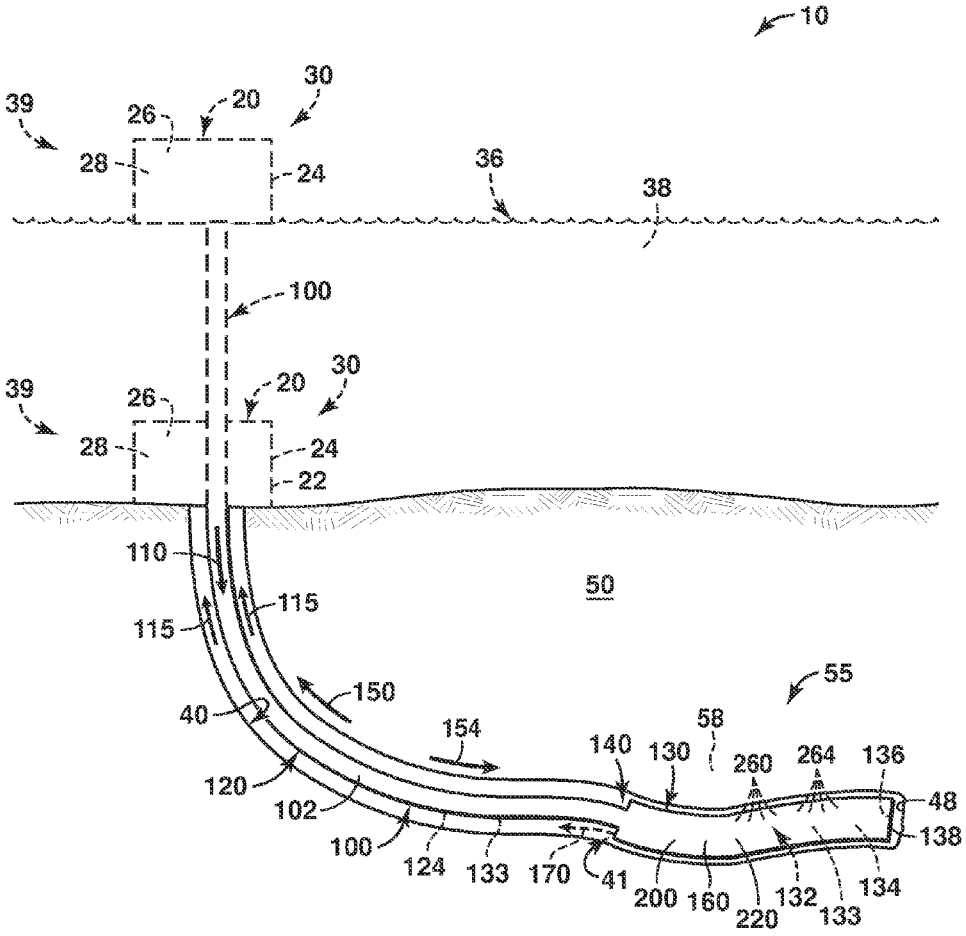
FIG. 1 is a schematic representation of illustrative, non-exclusive examples of a wellbore operation that may utilize and/or include the systems and methods according to the present disclosure.
Figure 2:
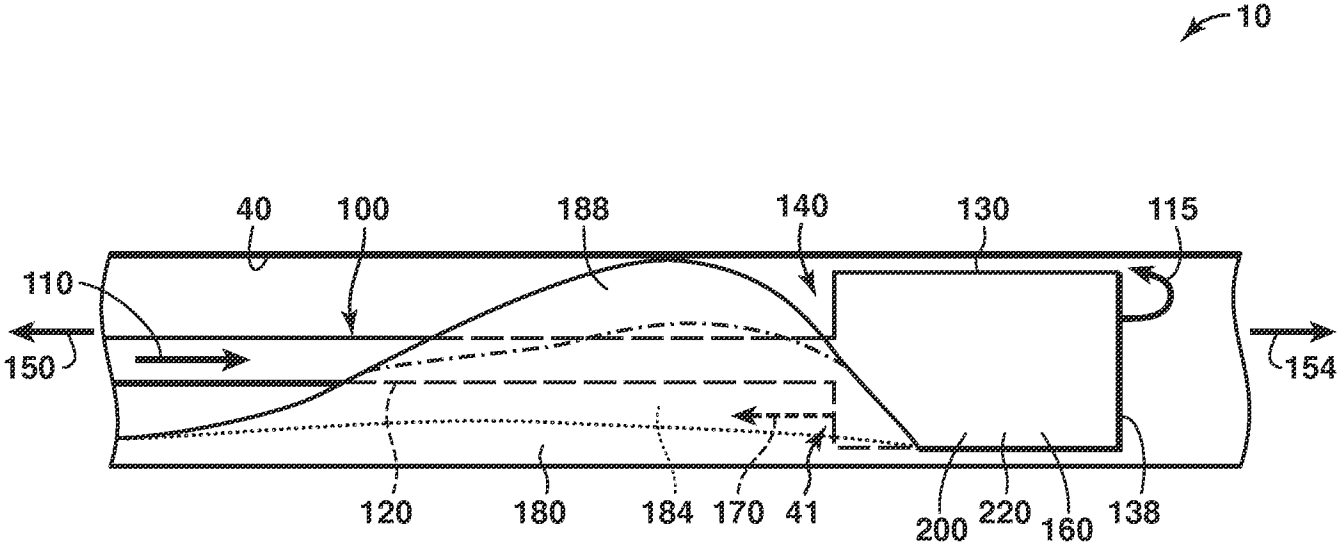
FIG. 2 is a schematic representation of illustrative, non-exclusive examples of a downhole assembly being removed in an uphole direction in a wellbore, such as to be removed from the wellbore.
Figure 3:
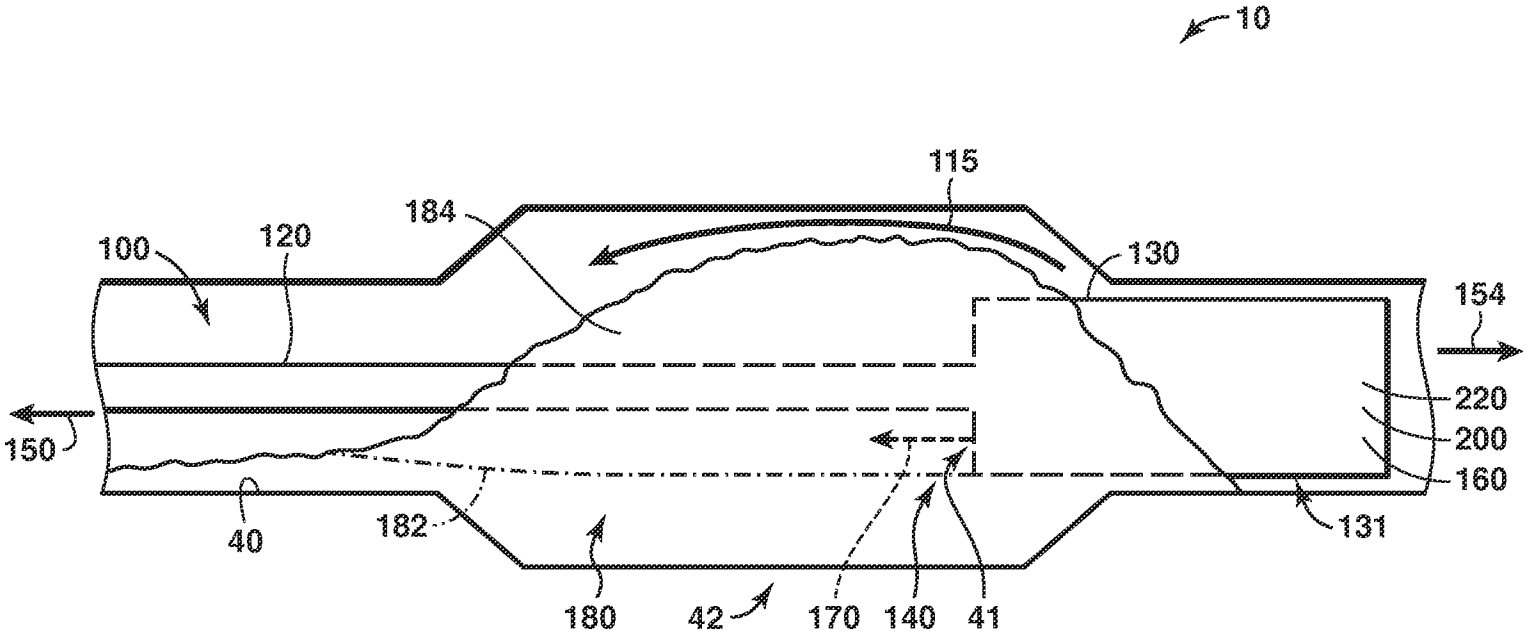
FIG. 3 is a schematic representation of an illustrative, non-exclusive example of a downhole assembly within a breakout section of a wellbore.

FIGS. 1-3 provide illustrative, non-exclusive examples of wellbore operations 10 that may include, utilize, and/or benefit from downhole assembly 100 and/or methods according to the present disclosure, while FIGS. 5-13 provide more detailed but still illustrative, non-exclusive examples of downhole assemblies 100, and/or portions thereof. Downhole assembly 100 additionally or alternatively may be referred to herein as, and/or as including, a bottom hole assembly 100, a BHA 100, a drilling assembly 100, and/or a downhole tool assembly 100.

As illustrated, downhole assembly 100 may include an energy-storing structure 200, a fluid propulsion device 220, and a fluidizing assembly 160 according to the present disclosure. Elements that serve a similar, or at least substantially similar, purpose are labeled with like numbers in each of FIGS. 1-3 and 5-13, and these elements may not be discussed in detail herein with reference to each of FIGS. 1-3 and 5-13. Similarly, all elements may not be labeled in each of FIGS. 1-3 and 5-13, but reference numerals associated therewith may be utilized herein for consistency. In general, elements that are likely to be included in a given embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 provides a schematic representation of illustrative, non-exclusive examples of a wellbore operation 10 that may utilize and/or include a downhole assembly 100 according to the present disclosure. In FIG. 1, a surface assembly 20, such as a drill rig, is in mechanical and/or fluid communication with a downhole assembly 100. The surface assembly may include a land-based surface assembly 22 that is located in a surface region 30 and/or a water-based surface assembly 24 that may be located above and/or beneath a surface 36 of a body of water 38. Downhole assembly 100 is configured to be conveyed within and/or to form, create, and/or drill a wellbore 40 within a subsurface region 50 that may include a subterranean formation 55. When subterranean formation 55 includes a hydrocarbon 58, wellbore 40 may form a portion of a hydrocarbon well 39.

Surface assembly 20 may include any suitable structure that is configured to utilize downhole assembly 100 during the formation of wellbore 40, to insert downhole assembly 100 into wellbore 40, and/or to remove the downhole assembly from the wellbore. As an illustrative, non-exclusive example, surface assembly 20 may include and/or be in communication with a mechanical drive assembly 26 that is configured to insert downhole assembly 100 into wellbore 40, remove downhole assembly 100 from wellbore 40, and/or rotate downhole assembly 100 around a longitudinal axis thereof while the downhole assembly is within the wellbore.

As another illustrative, non-exclusive example, surface assembly 20 may include and/or be in communication with a drilling fluid supply system 28 that is configured to provide a drilling fluid stream 110 to downhole assembly 100. Drilling fluid stream 110 may include any suitable fluid that is configured to facilitate insertion of downhole assembly 100 into wellbore 40, removal of downhole assembly 100 from wellbore 40, and/or lengthening of wellbore 40 with downhole assembly 100. Illustrative, non-exclusive examples of drilling fluid streams 110 according to the present disclosure include drilling fluid streams that include and/or contain drilling mud, water, water-based mud, oil-based mud, oil, clay, a viscosity-control additive, a stability-enhancing additive, a coolant, a lubricant, and/or a packoff-inhibiting additive.

Downhole assembly 100 may include a plurality of sections. In the depicted illustrative, non-exclusive example of FIG. 1, the plurality of sections includes at least a first section 120 and a second section 130. Sections 120 and 130 may include and/or comprise a drilling fluid conduit 102 that is configured to transmit drilling fluid stream 110 therethrough. A size, length, diameter, and/or cross-sectional area of first section 120 may be different from a size, length, diameter, and/or cross-sectional area of second section 130. Thus, a transition region 140 may be present between first section 120 and second section 130. Second section 130 may include any suitable length, and thus transition region 140 may be any suitable distance from a terminal end 138 of the downhole assembly. As illustrative, non-exclusive examples, transition region 140 may be at least 1 meter, at least 3 meters, at least 5 meters, at least 10 meters, at least 15 meters, at least 20 meters, at least 25 meters, at least 30 meters, at least 40 meters, or at least 50 meters from the terminal end of the downhole assembly.

As an illustrative, non-exclusive example, the cross-sectional area and/or another characteristic dimension of first section 120 may be less than the cross-sectional area and/or another characteristic dimension of second section 130. Illustrative, non-exclusive examples of characteristic dimensions according to the present disclosure include any suitable area, cross-sectional area, length, width, height, radius, diameter, and/or effective diameter. The characteristic dimension may be measured in any suitable relative direction, an illustrative, non-exclusive example of which includes a direction that is transverse to the longitudinal axis of downhole assembly 100 at the point where the characteristic dimension is measured. Illustrative, non-exclusive examples of effective diameters include the diameter of a circular cross-sectional shape and/or the diameter of a circle that has the same cross-sectional area as the cross-sectional area of the first section and/or the second section at the point of interest.

Transition region 140 may include and/or be defined or formed by any suitable structure that is configured to connect, operatively attach, and/or adapt first section 120 to second section 130. Illustrative, non-exclusive examples of transition regions 140 according to the present disclosure include any suitable coupling and/or threaded connection. Additionally or alternatively, transition region 140 may be defined and/or formed by an interface between the first and second sections, such as due to differences in cross-sectional shapes and/or areas of first section 120 and second section 130. Transition region 140 may have any suitable shape. As an illustrative, non-exclusive example, and as shown in FIG. 1, when first section 120 includes a cross-sectional area that is less than a cross-sectional area of second section 130, transition region 140 may include an abrupt, or stepped, transition between the first section and the second section. As another illustrative, non-exclusive example, transition region 140 also may include a gradual, staged, and/or tapered transition between first section 120 and second section 130.

When first section 120 includes a different cross-sectional area than second section 130, the cross-sectional area of second section 130 may be of any suitable magnitude relative to the cross-sectional area of first section 120. Illustrative, non-exclusive examples of ratios of the cross-sectional area of second section 130 to the cross-sectional area of first section 120 include ratios of at least 1.1:1, including ratios of at least 1.1:1, at least 1.2:1, at least 1.3:1, at least 1.4:1, at least 1.5:1, at least 1.6:1, at least 1.7:1, at least 1.8:1, at least 1.9:1, at least 2:1, at least 2.25:1, at least 2.5:1, at least 3:1, at least 4:1, or at least 5:1, and further optionally including ratios of between 1.1:1 and 2:1, between 1.5:1 and 3:1, or between 1.5:1 and 5:1.

First section 120 may be and/or include any suitable structure that is configured to provide a mechanical and fluid connection between (1) surface assembly 20 and/or surface region 30 and (2) second section 130. Illustrative, non-exclusive examples of first section 120 according to the present disclosure include drill pipe 124 and/or a drill string 133. Similarly, second section 130 may be and/or include any suitable structure that may form at least a portion of downhole assembly 100. Illustrative, non-exclusive examples of second section 130 according to the present disclosure include a bottom-hole assembly 132, a drill string 133, a drill collar 134, and/or a drill bit 136. Downhole assembly 100, first section 120, and/or second section 130 also may include additional structures and/or components, illustrative, non-exclusive examples of which include stabilizers, jars, downhole logging tools, and/or one or more components of a rotary steerable system.

Drill bit 136 may be present at terminal end 138 of downhole assembly 100 and/or second section 130 and may be configured to contact terminal end 48 of wellbore 40, such as to produce cuttings and increase the length of the wellbore in a drilling process. During the drilling process, surface assembly 20 may provide at least a portion of drilling fluid stream 110 to terminal end 138 of downhole assembly 100. The drilling fluid stream may cool and/or lubricate at least a portion of the downhole assembly, provide a motive force for drill bit 136, and/or provide a motive force for the transport of at least a portion of the cuttings produced during the drilling process in an uphole direction 150 and/or toward surface region 30. This may include entraining the cuttings within a return stream 115 of the drilling fluid that may flow from downhole assembly 100, such as from terminal end 138 thereof, toward surface region 30.

A flow of fluid, such as drilling fluid, and/or a motion of systems and/or assemblies, such as downhole assembly 100, within wellbore 40 may be described as being in uphole direction 150, in a downhole direction 154, and/or in a rotary direction, such as when downhole assembly 100 may rotate about a longitudinal axis thereof within wellbore 40. The uphole direction additionally or alternatively may be described as being toward surface region 30 generally along the wellbore. The downhole direction additionally or alternatively may be described as being toward terminal end 138 of downhole assembly 100 and/or terminal end 48 of wellbore 40.

As an illustrative, non-exclusive example, withdrawing downhole assembly 100 from wellbore 40 also may be described as moving at least a portion of the downhole assembly in uphole direction 150, moving at least a portion of the downhole assembly toward surface region 30, and/or moving at least a portion of the downhole assembly away from terminal end 48 of wellbore 40. As another illustrative, non-exclusive example, inserting downhole assembly 100 into wellbore 40 also may be described as moving at least a portion of the downhole assembly in downhole direction 154, moving at least a portion of the downhole assembly away from surface region 30, and/or moving at least a portion of the downhole assembly toward terminal end 48 of wellbore 40. As yet another illustrative, non-exclusive example, the drilling process may include rotating the downhole assembly within the wellbore while simultaneously providing at least a portion of the drilling fluid stream to the terminal end of the downhole assembly, moving the downhole assembly in a downhole direction, and/or flowing cuttings produced by the drilling process in an uphole direction with return stream 115.

FIG. 2 provides a schematic representation of illustrative, non-exclusive examples of downhole assembly 100 being removed from wellbore 40. As discussed in more detail herein, the downhole assembly may include transition region 140 between first section 120, which has a first cross-sectional area, and second section 130, which has a second cross-sectional area that is greater than the first cross-sectional area. In FIG. 2, the downhole assembly is depicted schematically as being withdrawn from wellbore 40 in uphole direction 150.

Initially, and as shown in dotted lines in FIG. 2, a cuttings bed 180 may be present on a bottom surface of at least a portion of wellbore 40. However, and as shown in dash-dot lines in FIG. 2, the motion of downhole assembly 100 within wellbore 40 may lead to the formation of a cuttings dune 184, or buildup of cuttings, on an uphole side of transition region 140. Under certain circumstances, and as shown as a solid line in FIG. 2 at 188, the cuttings dune may cause a packoff event, which may obstruct or otherwise preclude, or prevent, further motion of downhole assembly 100 within wellbore 40 in uphole direction 150. A similar effect may be observed when the downhole assembly is conveyed in downhole direction 154. As used herein, packoff event refers to when movement of the downhole assembly within the wellbore is prevented by an accumulation of cuttings within the wellbore, and more specifically, by the shear and other forces exerted on the downhole assembly thereby. A packoff event may additionally or alternatively be referred to herein as a packoff condition, a packoff situation, and/or simply just as packoff.

Conventionally, drilling fluid stream 110 may be provided to terminal end 138 of downhole assembly 100 when the downhole assembly is being removed from wellbore 40. However, and as shown in FIG. 2, the presence of a large cuttings dune and/or the occurrence of a packoff event within the wellbore may direct, or otherwise divert, a substantial portion, a majority, and/or all of return stream 115 that is produced from drilling fluid stream 110 along a top surface and/or in an upper region of wellbore 40, thereby decreasing the effectiveness of the return stream at removing cuttings from the wellbore, especially in the region of the cuttings dune.

However, it is also within the scope of the present disclosure that the drilling fluid stream may not be provided to terminal end 138 of the downhole assembly and/or may be intermittently provided to the terminal end of the downhole assembly when the downhole assembly is being removed from the wellbore. As an illustrative, non-exclusive example, and during removal of the downhole assembly from the wellbore, drilling fluid stream 110 may be provided to the terminal end of the downhole assembly responsive to formation of cuttings dune 184 within the wellbore and/or occurrence of the packoff event.

FIG. 3 provides a schematic representation of an illustrative, non-exclusive example of downhole assembly 100 within and/or proximal to a breakout region 42 of wellbore 40, which also may be referred to herein as a breakout section 42 of the wellbore. In FIG. 3, wellbore 40 includes breakout region 42, where a cross-sectional area of the wellbore may be larger than a nominal, designed, and/or desired cross-sectional area of the wellbore. When wellbore 40 includes breakout region 42, a velocity of return stream 115 within the breakout region may be less than a velocity of the return stream within a nominal-diameter wellbore, such as uphole and/or downhole of the breakout region. This may be due to the increased cross-sectional area of the annular region between the downhole assembly and the wellbore within the breakout region and may lead to deposition of cuttings within and/or proximal to the breakout region. This deposition, or accumulation, of cuttings in the breakout region may increase dune formation and increase a potential for packoff proximal to the breakout region.

Regardless of the presence or absence of breakout region 42 within wellbore 40, movement of first section 120, second section 130, and/or transition region 140 through cuttings bed 180 in uphole direction 150 may lead to the formation of cuttings dune 184. When second section 130 is pulled through the cuttings bed, it may exert a compressive stress on the cuttings contained therein. A granular material, such as cuttings bed 180, that is subject to a compressive stress may experience shear failure along a surface of lowest shear strength 182, as schematically depicted in dash dot lines in FIG. 3. Failure and/or motion of cuttings bed 180 along surface of lowest shear strength 182, which may tend to be parallel to a lower surface 131 of second section 130 and may lead to the formation of cuttings dune 184 as downhole assembly 100 is moved through wellbore 40 and additional cuttings collect behind second section 130.

In a closely packed bed of solid particles, such as cuttings bed 180, fluid may occupy a pore space between the solid particles. Under these conditions, the lubricating nature of the fluid may decrease significantly friction and/or resistance to motion among the particles. When a compressive stress is exerted on the cuttings bed by second section 130, it is balanced by an opposite stress that is applied to the second section by the cuttings bed. This bed stress may be described by:

$$\sigma_{total}=P_{fluid}+\sigma_{solid}$$

Where $\sigma_{total}$ is the total stress that is applied to the second section by the cuttings bed, $P_{fluid}$ is a pressure of the fluid that occupies the pore space between the solid particles, and $\sigma_{solid}$ is the solid-solid effective stress due to friction and/or resistance to motion among the cuttings particles that comprise the cuttings bed. Often, the pressure of the fluid that occupies the pore space is significantly less than the total stress. Under these conditions, the solid-solid effective stress may be large in order for the total stress to balance the stress that is applied to the cuttings bed by the second section. According to the Mohr Coulomb theory, this leads to a large shear stress requirement to move the cuttings bed, resulting in a large resistance to motion.

Figure 4:
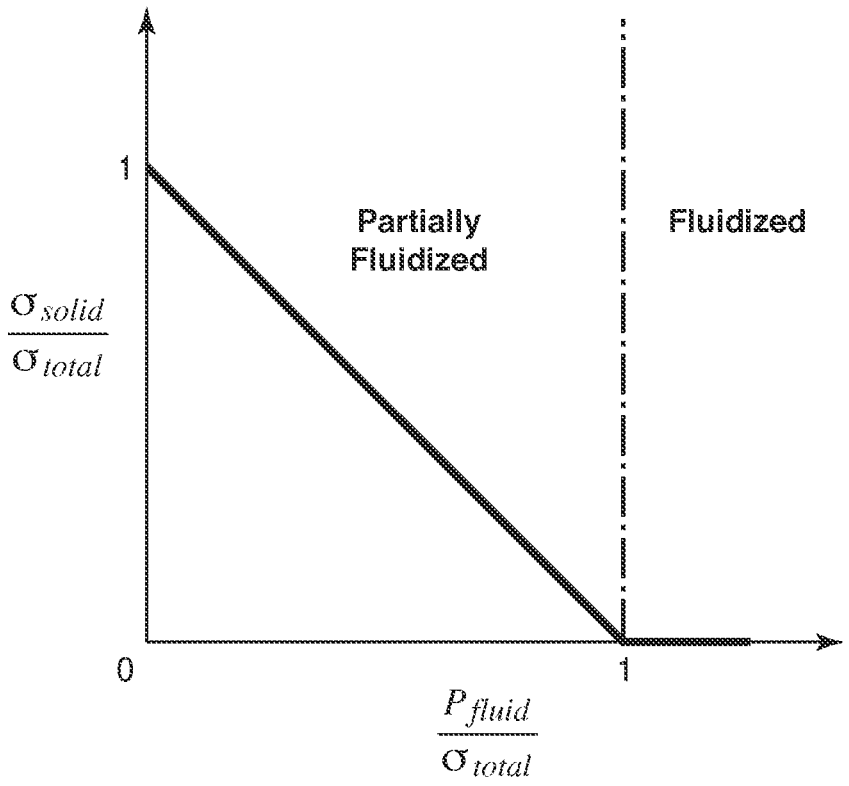
FIG. 4 is a schematic graph depicting solid-solid shear stress as a function of fluid pressure normalized by the total stress.

However, by increasing the fluid pressure in the vicinity of transition region 140, the solid-solid stress may be decreased and/or substantially eliminated. This is shown in FIG. 4, which is a schematic graph depicting solid-solid shear stress as a function of fluid pressure normalized by the total stress. FIG. 4 illustrates that, at low normalized fluid pressures, such as are shown on the left side of the graph, solid-solid stress is high, which may increase the likelihood of a packoff event by resisting the motion of the downhole assembly within the wellbore and/or increasing the rate of cuttings dune formation. However, as the fluid pressure is increased, solid-solid stress decreases substantially, eventually approaching zero as the fluid pressure approaches the total stress.

As shown in FIG. 4, a cuttings bed that includes a decreased solid-solid stress due to increased pore pressure may be referred to herein as being partially fluidized and/or as a partially fluidized cuttings bed. Similarly, a cuttings bed that includes a small, negligible, or substantially nonexistent solid-solid stress due to a pore pressure that is equal to and/or greater than the total applied stress may be referred to herein as being fluidized and/or as a fluidized cuttings bed. While a cuttings bed that includes substantial solid-solid stresses may, under certain circumstances, behave as a solid, a partially fluidized and/or a fluidized cuttings bed may behave (at least partially, or substantially) as a fluid. Under these conditions, resistance to the motion of the downhole assembly due to solid-solid interactions within the cuttings bed may be substantially decreased and/or eliminated, thereby decreasing a resistance to motion of the downhole assembly and decreasing a potential for packoff as the downhole assembly is removed from the wellbore.

In addition, while fluid jets or similar devices that emit fluid at high velocity might be utilized to displace at least a portion of the cuttings bed present within wellbore 40 in an uphole direction relative to a location of the second section, this displaced portion of the cuttings bed is still uphole from the second section and thus may cause a future packoff event as the second section is removed from the wellbore. In contrast, partial and/or complete fluidization of at least a portion of the cuttings bed may decrease a resistance to motion of the downhole assembly and provide for motion of the downhole assembly through the cuttings bed without substantial relocation of the portion of the cuttings bed, thereby decreasing a potential for cuttings accumulation and/or packoff at an uphole location as the downhole assembly is removed from the wellbore.

Figure 5:
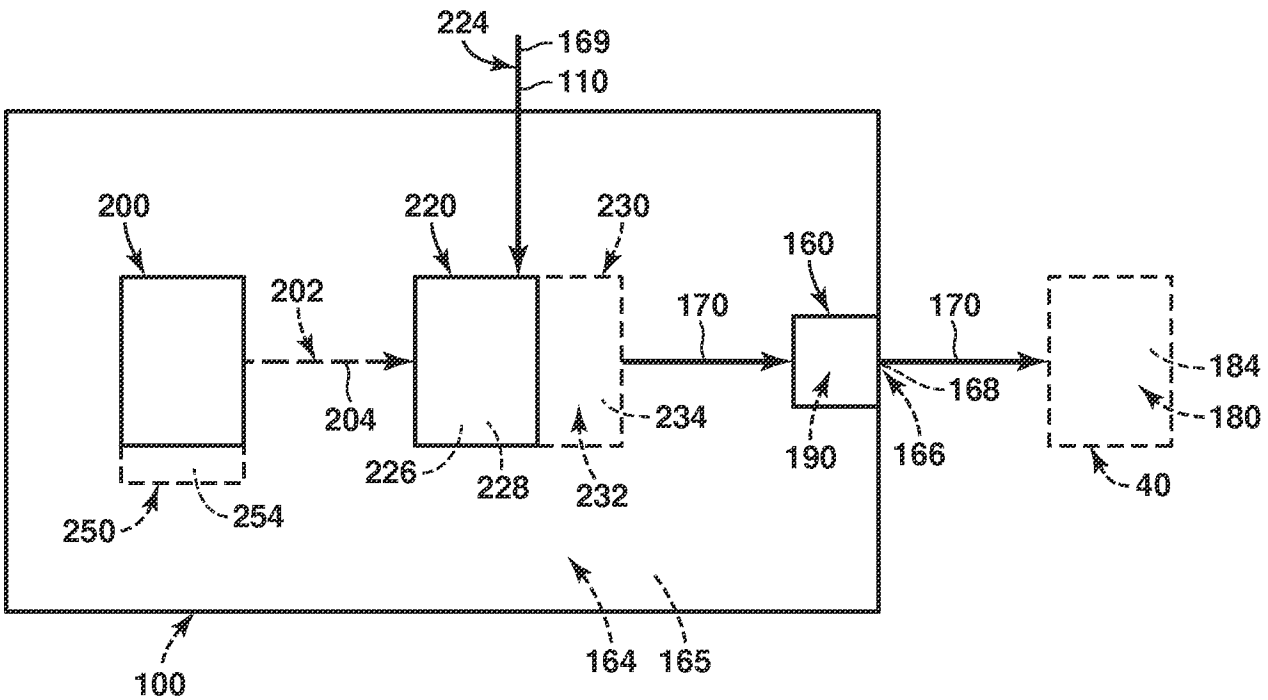
FIG. 5 is a block diagram depicting illustrative, non-exclusive examples of a downhole assembly according to the present disclosure.

In order to decrease a potential for packoff within wellbore 40, the systems and methods according to the present disclosure may include a downhole assembly 100 that includes a fluidizing assembly 160, an energy-storing structure 200, and a fluid propulsion device 220 that is configured to emit a fluidizing stream 170, which may be provided to and/or injected into cuttings bed 180. This is illustrated in FIGS. 1-3 and shown in more detail in FIGS. 5-11. FIG. 5 is a block diagram depicting illustrative, non-exclusive examples of downhole assemblies 100 according to the present disclosure. FIGS. 6-11 are less schematic but still illustrative, non-exclusive examples of downhole assemblies 100 according to the present disclosure.

As discussed, FIGS. 5-11 represent illustrative, non-exclusive examples of downhole assemblies 100 according to the present disclosure in varying levels of detail. With this in mind, any of the components, features, designs, subsystems, and/or parts that are discussed herein with respect to any one of FIGS. 5-11 may be utilized with any downhole assembly 100 according to the present disclosure (such as any downhole assembly that is illustrated and/or discussed herein with reference to any other of FIGS. 1-3 and 5-11) without departing from the scope of the present disclosure.

As illustrated in FIG. 5, downhole assembly 100 includes an energy-storing structure 200 that is configured to provide a motive force 204 to a fluid propulsion device 220. Motive force 204 also may be referred to herein as activation force 204 and/or driving force 204.

Fluid propulsion device 220 is configured to receive a fluid stream 224, such as drilling fluid stream 110 and/or wellbore fluid stream 169, and to produce and/or generate fluidizing stream 170. This fluidizing stream may be formed from fluid, such as drilling fluid and/or wellbore fluid, although it is also within the scope of the present disclosure that the fluid propulsion device generates fluidizing stream 170 from other fluid that is delivered to and/or stored within the downhole assembly.

As schematically illustrated in FIG. 5, fluid propulsion device 220 may be configured to produce and/or generate fluidizing stream 170 therefrom. This may include generating the fluidizing stream responsive to receipt of motive force 204, generating the fluidizing stream during receipt of the motive force, generating the fluidizing stream while receiving the motive force, and/or generating the fluidizing stream with the motive force. Fluidizing stream 170 may be provided to a fluidizing assembly 160, which may emit the fluidizing stream from the downhole assembly and provide the fluidizing stream to wellbore 40 and/or cuttings bed 180 that is contained therein to fluidize a portion of the cuttings bed. Although not required, fluidizing of a portion of cuttings bed 180, as used herein, additionally or alternatively may be referred to as hydrating and/or dispersing the portion of the cuttings bed.

In operation, downhole assembly 100 may be moved in a longitudinal (i.e., uphole and/or downhole) direction within wellbore 40. As discussed herein, formation of cuttings dune 184 within wellbore 40 and proximal to downhole assembly 100 may generate a packoff event, in which the downhole assembly may stick (i.e., be functionally retained) within the wellbore and/or in which motion of the downhole assembly may be resisted by the cuttings dune. Under these conditions, an axial force within at least a portion of the downhole assembly that may be necessary to produce motion of the downhole assembly within the wellbore may increase.

When this axial force increases to a magnitude that is greater than a threshold axial force, energy-storing structure 200 may generate motive force 204, thereby causing downhole assembly 100 to emit fluidizing stream 170 and fluidize a portion of cuttings bed 180. This fluidization of the portion of the cuttings bed may decrease the magnitude of the axial force that is needed to produce motion of the downhole assembly, thereby at least temporarily freeing the downhole assembly from the packoff event.

Energy-storing structure 200 may include, exist in, and/or define at least a charged state and a discharged state and may be configured to generate the motive force by, while, and/or responsive to transitioning from the charged state to the discharged state. As an illustrative, non-exclusive example, and while in the charged state, energy-storing structure 200 may store, retain, and/or otherwise hold a quantity of energy. Additionally or alternatively, and in the discharged state, the energy-storing structure may release, may not store, may not retain, and/or may not otherwise hold or contain the quantity of energy.

It is within the scope of the present disclosure that the quantity of energy may include any suitable form of energy that may be stored and subsequently released from the energy-storing structure. As illustrative, non-exclusive examples, the quantity of energy may include a quantity of potential energy, a quantity of mechanical energy, a quantity of pneumatic energy, and/or a quantity of chemical energy.

It is also within the scope of the present disclosure that the energy-storing structure may include any suitable structure. As illustrative, non-exclusive examples, the energy-storing structure may include, be, and/or form a portion of a mechanical energy-storing structure, a resilient member, a spring, a chemical compound, an explosive charge, a surface assembly, a drill pipe, a captured volume of gas, and/or a compressed volume of gas.

It is within the scope of the present disclosure that energy-storing structure 200 may be configured to transition from the charged state to the discharged state in less than a threshold elapsed time. Illustrative, non-exclusive examples of threshold elapsed times according to the present disclosure include threshold elapsed times of less than 10 seconds, less than 8 seconds, less than 6 seconds, less than 4 seconds, less than 2 seconds, less than 1 second, or less than 0.5 seconds.

In addition to generating motive force 204, energy-storing structures 200 according to the present disclosure also may be (but are not required to be) configured to produce and/or otherwise generate an axial force, which also may be referred to herein as a jarring force, on downhole assembly 100 when transitioned from the charged state to the discharged state. This axial force may be directed in uphole direction 150 and/or downhole direction 154 (as illustrated in FIGS. 1-3 and 6-11) and further may contribute to and/or aid in freeing the downhole assembly from the packoff event.

As discussed in more detail herein, energy-storing structures 200 according to the present disclosure may be configured, designed, and/or constructed to be repeatedly transitioned between the charged state and the discharged state. This may include repeatedly charging the energy-storing structure by transitioning the energy-storing structure from the discharged state to the charged state, as well as repeatedly discharging the energy-storing structure by transitioning the energy-storing structure between the charged state and the discharged state. This may include transitioning the energy-storing structure without damage to the energy-storing structure and/or to another component of downhole assembly 100. Illustrative, non-exclusive examples of such energy-storing structures include mechanical energy-storing structures, resilient members, springs, the surface assembly, the drill pipe, the captured volume of gas, and/or the compressed volume of gas.

Additionally or alternatively, energy-storing structures 200 according to the present disclosure also may include and/or be single-use energy-storing structures that may be configured to transition from the charged state to the discharged state a single time. Illustrative, non-exclusive examples of such energy-storing structures include chemical compounds and/or explosive charges that are configured to undergo an irreversible chemical reaction upon transitioning from the charged state to the discharged state.

As indicated in dashed lines in FIG. 5, downhole assembly 100 may include and/or be associated with a release mechanism 250 that may be configured to control the transitioning of the energy-storing structure between the charged state and the discharged state. This may include selectively controlling the charging of the energy-storing structure and/or selectively controlling the discharging of the energy-storing structure.

As an illustrative, non-exclusive example, release mechanism 250 may be configured to retain the energy-storing structure in the charged state and to selectively permit the energy-storing structure to transition to the discharged state. This may include permitting the energy-storing structure to transition to the discharged state responsive to application of an axial force to the portion of the downhole assembly that is greater than the threshold axial force. This may include application of a tensile force to a portion of the downhole assembly that is greater than a threshold tensile force and/or application of a compressive force to the portion of the downhole assembly that is greater than a threshold compressive force.

Additionally or alternatively, downhole assembly 100 further may include a detector 254 that is configured to detect the axial force, and the release mechanism may be configured to permit the energy-storing structure to transition to the discharged state responsive to detecting that the axial force is greater than the threshold axial force. The portion of the downhole assembly that receives the above-discussed force(s) and/or in which the force is measured or otherwise detected may include any suitable section, region, and/or component of the downhole assembly, such as first section 120, second section 130, and/or any suitable drill pipe, bottom hole assembly, drill string, and/or drill bit that may be associated therewith.

As an illustrative, non-exclusive example, and with reference to FIG. 1, when downhole assembly 100 is being removed from wellbore 40 (i.e., being moved in uphole direction 150), first section 120 may be placed in tension due to application of a tensile force to first section 120 by surface assembly 20. Under these conditions, and should packoff occur, the tensile force may exceed the threshold tensile force, causing release mechanism 250 to release energy-storing structure 200 and/or to permit the energy-storing structure to transition from the charged state to the discharged state.

As another illustrative, non-exclusive example, and with continued reference to FIG. 1, when downhole assembly 100 is being moved toward terminal end 48 of wellbore 40 (i.e., being moved in downhole direction 154), first section 120 may be placed in compression due to application of a compressive force to the first section by surface assembly 20. Under these conditions, and should packoff occur, the compressive force may exceed the threshold compressive force, causing release mechanism 250 to release energy-storing structure 200 and/or to permit the energy-storing structure to transition from the charged state to the discharged state.

Returning to FIG. 5, release mechanism 250 may include any suitable structure that is configured to selectively control the transitioning of energy-storing structure 200. As an illustrative, non-exclusive example, release mechanism 250 may include and/or be a resettable and/or reusable release mechanism. When the release mechanism is a resettable release mechanism, the release mechanism may be configured to selectively control the transitioning of the energy-storing structure a plurality of times without damage to the release mechanism.

As another illustrative, non-exclusive example, release mechanism 250 may include and/or be a passive release mechanism and/or an active release mechanism. Illustrative, non-exclusive examples of passive release mechanisms include release mechanisms that are actuated directly responsive to the axial force and are discussed in more detail herein with reference to FIGS. 12-13. Illustrative, non-exclusive examples of active release mechanisms include hydraulically actuated release mechanisms, electrically actuated release mechanisms, and/or mechanically actuated release mechanisms that may be actuated responsive to detecting the magnitude of the axial force. This may include actuating the active release mechanism from the surface region.

As discussed, fluid propulsion device 220 may be configured to receive the motive force from energy-storing structure 200 and to generate fluidizing stream 170 therefrom. This may include the use of any suitable system and/or structure, such as a linkage 202, to convey the motive force from the energy-storing structure to the fluid propulsion device, as well as any suitable system and/or structure to generate the fluidizing stream from the motive force.

As an illustrative, non-exclusive example, fluid propulsion device 220 may include any suitable pump 226 and/or turbine 228 that is configured to receive the motive force and to generate fluidizing stream 170. This may include receiving any suitable fluid stream 224, such as wellbore fluid stream 169 and/or drilling fluid stream 110 with the fluid propulsion device and pressurizing the fluid stream to generate the fluidizing stream.

As another illustrative, non-exclusive example, and as discussed in more detail herein with reference to FIGS. 6-11 and indicated in dashed lines in FIG. 5, fluid propulsion device 220 may be in fluid communication with and/or may be a fluid reservoir 230. Fluid reservoir 230 may define an internal volume 232 that is configured to retain a volume 234 of fluid when the energy-storing structure is in the charged state and to expel at least a portion of the volume of fluid from the internal volume as fluidizing stream 170 when the energy-storing structure transitions from the charged state to the discharged state. As an illustrative, non-exclusive example, fluid reservoir 230 may be configured to receive and store fluid stream 224, and fluid propulsion device 220 may be configured to receive the fluid stream from the fluid reservoir and generate fluidizing stream 170 therefrom when energy-storing structure 200 transitions from the charged state to the discharged state.

As another illustrative, non-exclusive example, fluid reservoir 230 may define an expanded state that defines, or identifies with, an expanded internal volume and a contracted state that defines, or identifies with, a contracted internal volume. The expanded internal volume may be greater than the contracted internal volume. Under these conditions, fluid reservoir 230 may be fluid propulsion device 220 and may be configured to expel at least a portion of volume 234 of fluid therefrom upon transitioning from the expanded state to the contracted state, thereby generating fluidizing stream 170. As an illustrative, non-exclusive example, energy-storing structure 200 may be configured to provide motive force 204 to fluid reservoir 230 (such as through linkage 202) by transitioning from the charged state to the discharged state, and application of the motive force to the fluid reservoir may transition the fluid reservoir from the expanded state to the contracted state. Similar to energy-storing structure 200 and/or release mechanism 250, fluid reservoir 230 may be configured to repeatedly transition between the expanded state and the contracted state without damage to the fluid reservoir.

Fluidizing assembly 160 may be configured to receive fluidizing stream 170 from fluid propulsion device 220 and to emit the fluidizing stream from the downhole assembly. Additionally or alternatively, the fluidizing assembly also may be configured to provide the fluidizing stream to cuttings bed 180 to fluidize the portion of the cuttings bed. As discussed, this may include increasing a local pressure within the portion of the cuttings bed to fluidize the cuttings bed and/or decreasing a solid-solid shear stress within the portion of the cuttings bed to fluidize the cuttings bed.

As an illustrative, non-exclusive example, fluidizing assembly 160 may be configured to emit the fluidizing stream from the downhole assembly and into wellbore 40 in a region of the wellbore that is proximate to, near, and/or within a threshold distance of transition region 140 (as illustrated in FIGS. 1-3 and 6-11). Additionally or alternatively, the fluidizing assembly may be configured to fluidize the portion of the cuttings bed that is within the threshold distance of the transition region. Illustrative, non-exclusive examples of threshold distances according to the present disclosure include threshold distances of less than 4 meters, less than 3.5 meters, less than 3 meters, less than 2.5 meters, less than 2 meters, less than 1.5 meters, less than 1 meter, less than 0.75 meters, less than 0.5 meters, less than 0.25 meters, less than 0.2 meters, less than 0.15 meters, less than 0.1 meters, or less than 0.05 meters.

It is within the scope of the present disclosure that fluidizing assembly 160 may include and/or be any suitable structure. As illustrative, non-exclusive examples, the fluidizing assembly may include and/or be a fluidizing stream discharge orifice 166, such as a diffuser 168. Fluidizing stream discharge orifice 166 may include any suitable structure that is configured to provide the fluidizing stream to the portion of the cuttings bed, and it is within the scope of the present disclosure that fluidizing stream discharge orifice 166 may include a fixed orientation fluid orifice and/or a variable orientation fluid orifice and may be located at any suitable location around a circumference of and/or along a length of downhole assembly 100, first section 120, second section 130, transition region 140, and/or any suitable component thereof (as illustrated in FIGS. 1-3 and 6-11).

It is within the scope of the present disclosure that fluidizing assembly 160 may include any suitable number of fluidizing stream discharge orifices 166, including 1, 2, 3, 4, 5, more than 5, more than 10, more than 15, or more than 20 fluidizing stream discharge orifices. Each of the one or more fluidizing stream discharge orifices that comprise the fluidizing assembly may include any suitable inner diameter, illustrative, non-exclusive examples of which include inner diameters of 0.25-5 cm, such as inner diameters of 0.5-4.5 cm, 0.75-4 cm, 1-3 cm, 1.5-2.5 cm, 2-3 cm, 0.25 cm, 0.5 cm, 0.75 cm, 1 cm, 1.5 cm, 2 cm, 2.5 cm, 2.54 cm, 3 cm, or 3.5 cm.

As discussed in more detail herein, fluidizing assembly 160 may be configured to increase the pressure within the portion of the cuttings bed to thereby fluidize the portion of the cuttings bed. Thus, and in contrast to jets that may be configured to include a large pressure drop thereacross and thus a high fluid velocity at the outlet from the jet, fluidization assemblies 160 according to the present disclosure may be configured for a relatively small pressure drop across the fluidizing assembly in order to transmit the higher pressure of fluidizing stream 170 to the fluid present within the portion of the cuttings bed. Illustrative, non-exclusive examples of pressure drops across fluidizing assembly 160, fluidizing stream discharge orifice 166, and/or diffuser 168 according to the present disclosure include pressure drops that are less than 50%, less than 40%, less than 30%, less than 25%, less than 20%, less than 15%, less than 10%, less than 5%, less than 3%, or less than 1% of the pressure of the fluidizing stream as generated by fluid propulsion device 220.

Downhole assembly 100 and/or fluidizing assembly 160 also may include and/or be in communication with an orientation control assembly 164 that is configured to control an orientation of at least a portion of the fluidizing assembly. As an illustrative, non-exclusive example, orientation control assembly 164 may be configured to selectively control the orientation of the portion of the fluidizing assembly to direct, or otherwise selectively provide, the fluidizing stream to the portion of the cuttings bed. This may include selectively controlling a direction of fluidizing stream 170, such as by controlling an orientation of fluidizing stream discharge orifice 166. The orientation of fluidizing stream discharge orifice 166 may be controlled with respect to any suitable location and/or structure, illustrative, non-exclusive examples of which include the downhole assembly, the wellbore, and/or the cuttings bed. Additionally or alternatively, the orientation of fluidizing stream discharge orifice 166 may be controlled to direct the fluidizing stream that is discharged therefrom toward the cuttings bed.

As another illustrative, non-exclusive example, orientation control assembly 164 may include and/or be in communication with a rotary steerable system 165 that is nominally configured to control an orientation of wellbore 40 as it is created within surface region 30. The rotary steerable system may be configured to control the orientation of fluidizing assembly 160, such as orientation control assembly 164.

As discussed in more detail herein, fluidizing assembly 160 further may include and/or be in fluid communication with a flow control assembly 190. Flow control assembly 190 may be configured to control a flow of fluidizing stream 170 therethrough. As an illustrative, non-exclusive example, flow-control assembly 190 may include and/or be an orifice that is configured to control a flow rate of the fluidizing stream. As another illustrative, non-exclusive example, flow-control assembly 190 may include and/or be a check valve that is configured to control a direction of the flow of the fluidizing stream. This may include permitting the flow of the fluidizing stream from the downhole assembly into the wellbore and resisting the flow of the fluidizing stream from the wellbore into the downhole assembly.

FIGS. 6-11 provide less schematic longitudinal cross-sectional views of illustrative, non-exclusive examples of downhole assemblies 100 and/or portions thereof according to the present disclosure. The downhole assemblies of FIGS. 6-11 include a fluid propulsion device 220 in the form of a fluid reservoir 230. The fluid reservoir defines an internal volume 232 that may contain a volume 234 of fluid (such as a portion of drilling fluid stream 110).

Figure 6:
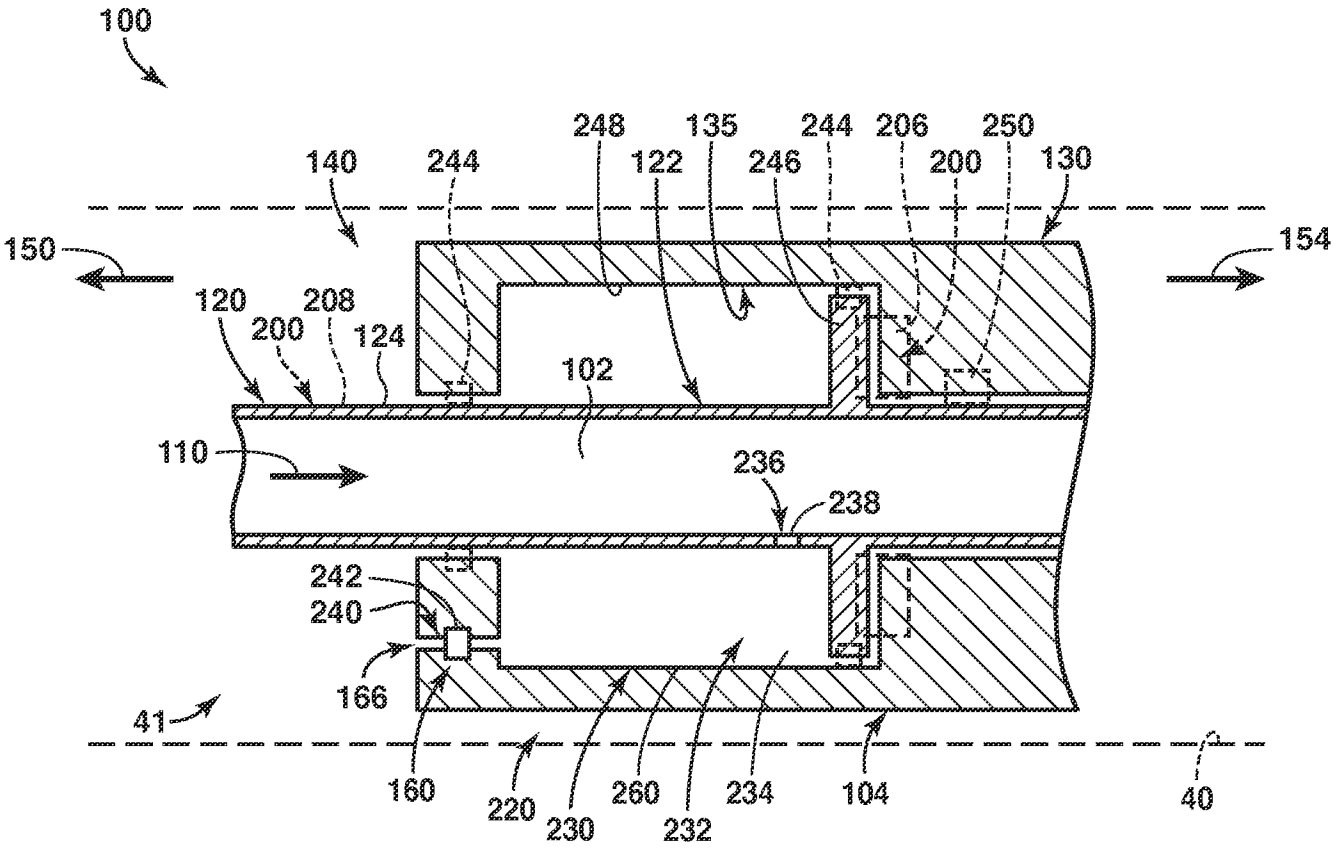
FIG. 6 is a less schematic longitudinal cross-sectional view of illustrative, non-exclusive examples of a downhole assembly according to the present disclosure that includes an energy-storing structure and a fluid reservoir, wherein the fluid reservoir is in an expanded state.
Figure 7:
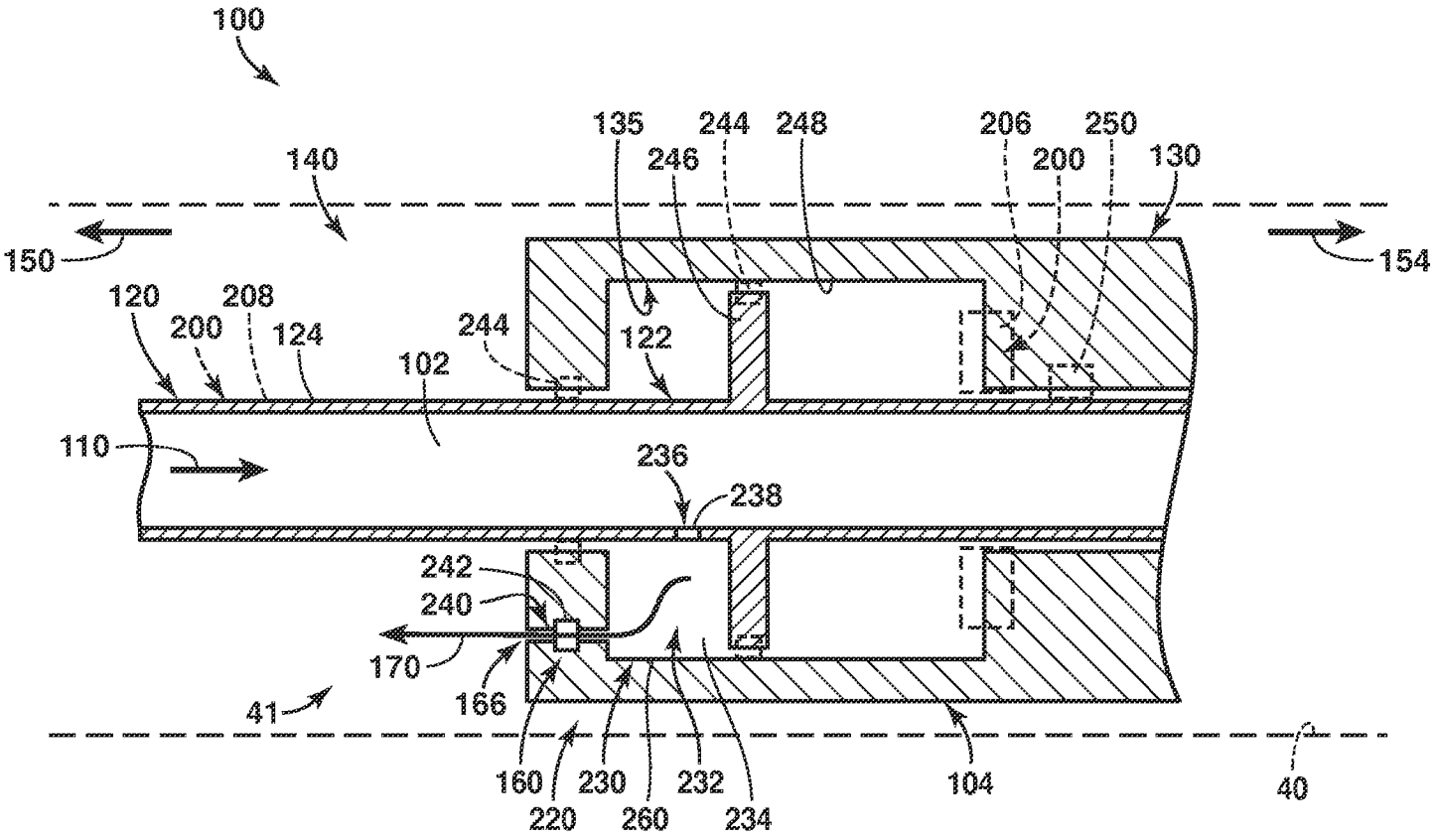
FIG. 7 is a less schematic longitudinal cross-sectional view of illustrative, non-exclusive examples of the downhole assembly of FIG. 6 emitting a fluidizing stream while the fluid reservoir is transitioning from the expanded state to a contracted state.
Figure 8:
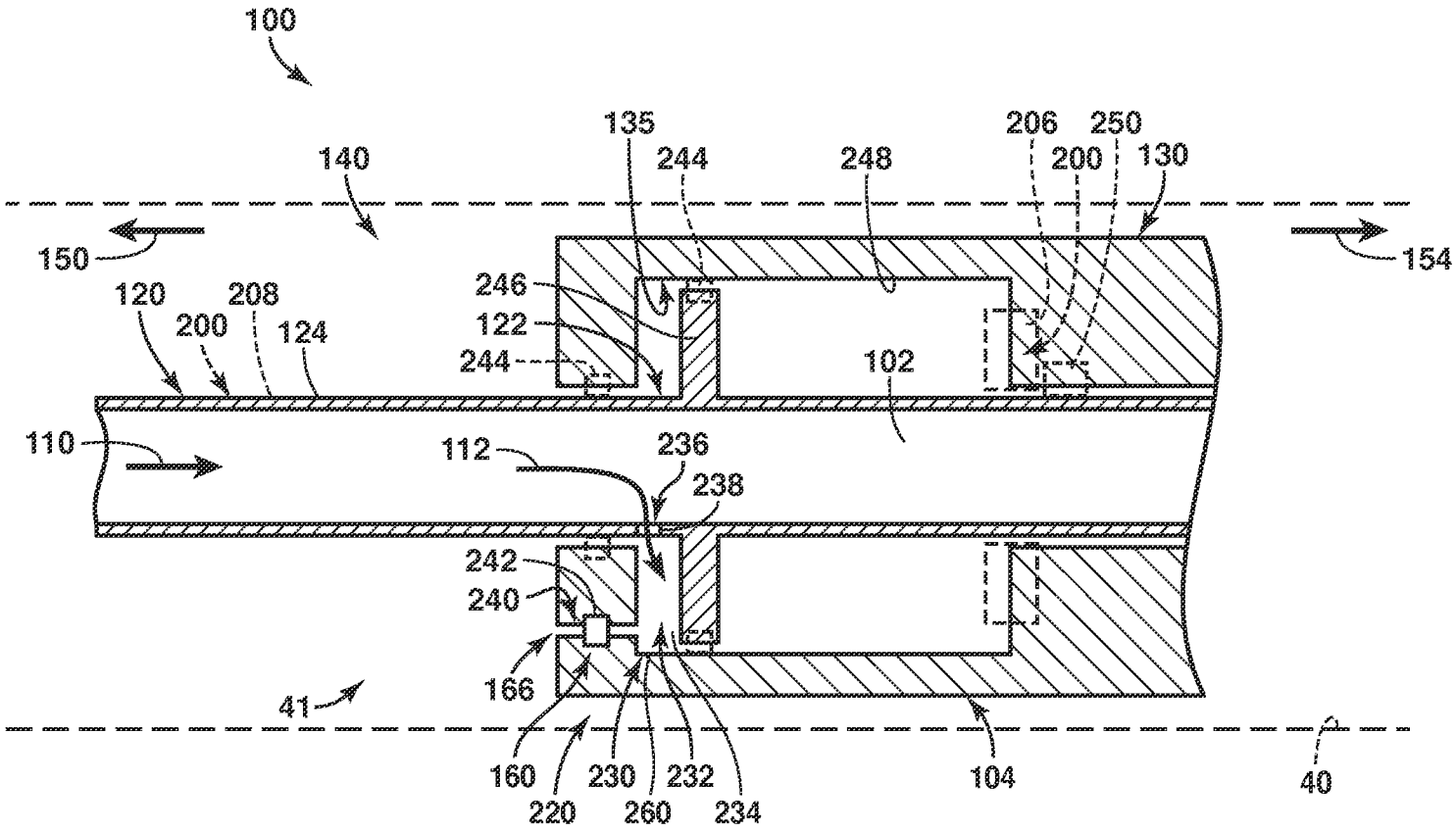
FIG. 8 is a less schematic longitudinal cross-sectional view of illustrative, non-exclusive examples of the downhole assembly of FIG. 6, wherein the fluid reservoir is being filled by transitioning from the contracted state to the expanded state.
Figure 9:
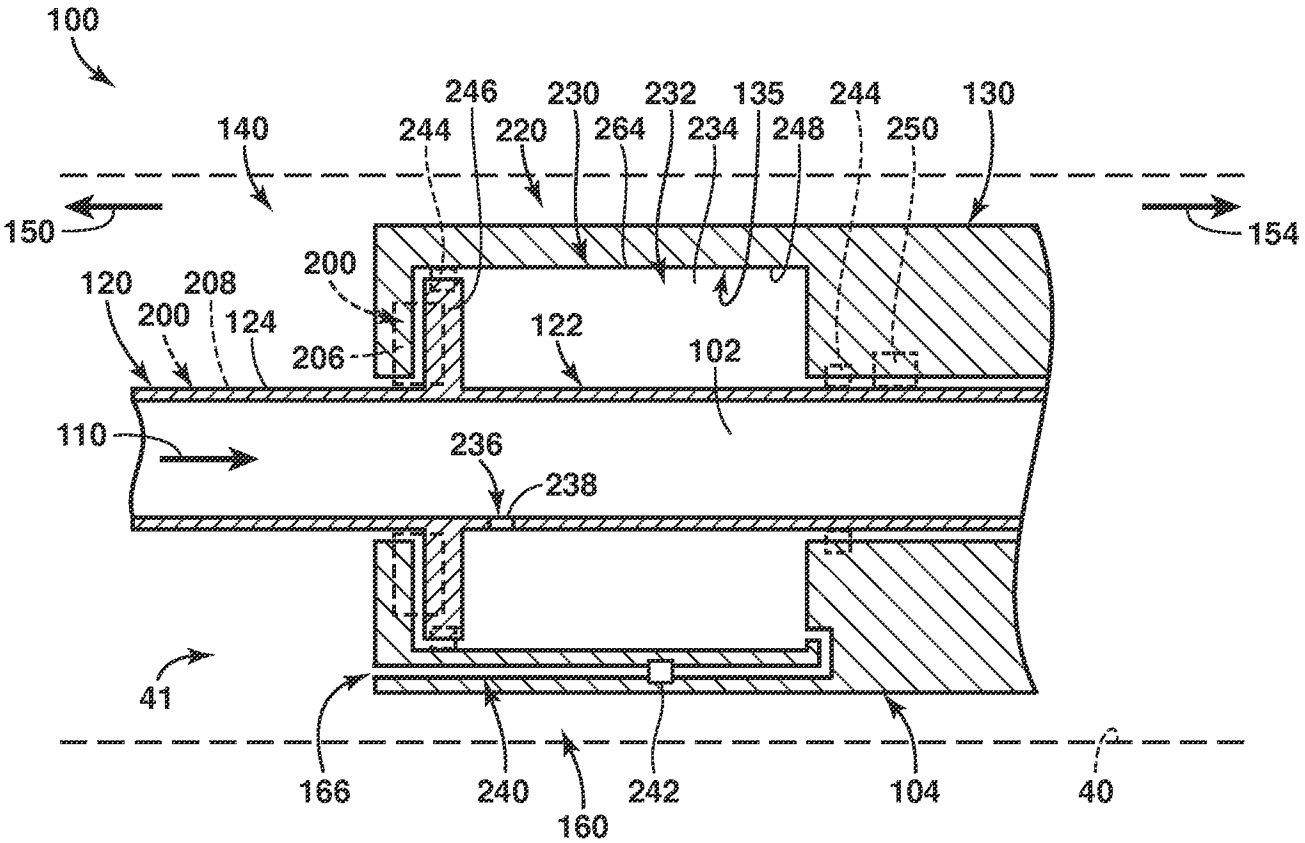
FIG. 9 is a less schematic longitudinal cross-sectional view of illustrative, non-exclusive examples of another downhole assembly according to the present disclosure that includes an energy-storing structure and a fluid reservoir, wherein the fluid reservoir is in an expanded state.
Figure 10:
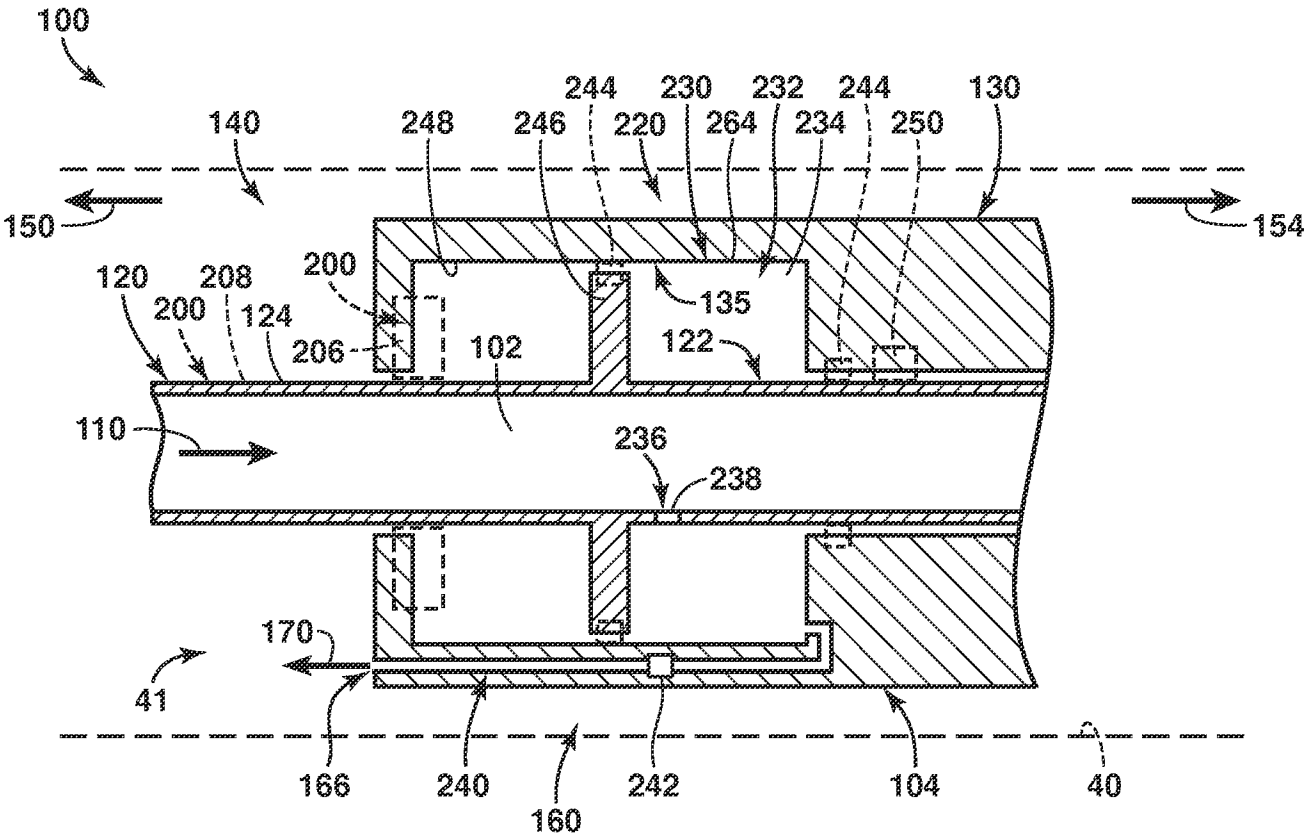
FIG. 10 is a less schematic longitudinal cross-sectional view of illustrative, non-exclusive examples of the downhole assembly of FIG. 9 emitting a fluidizing stream while the fluid reservoir is transitioning from the expanded state to a contracted state.
Figure 11:
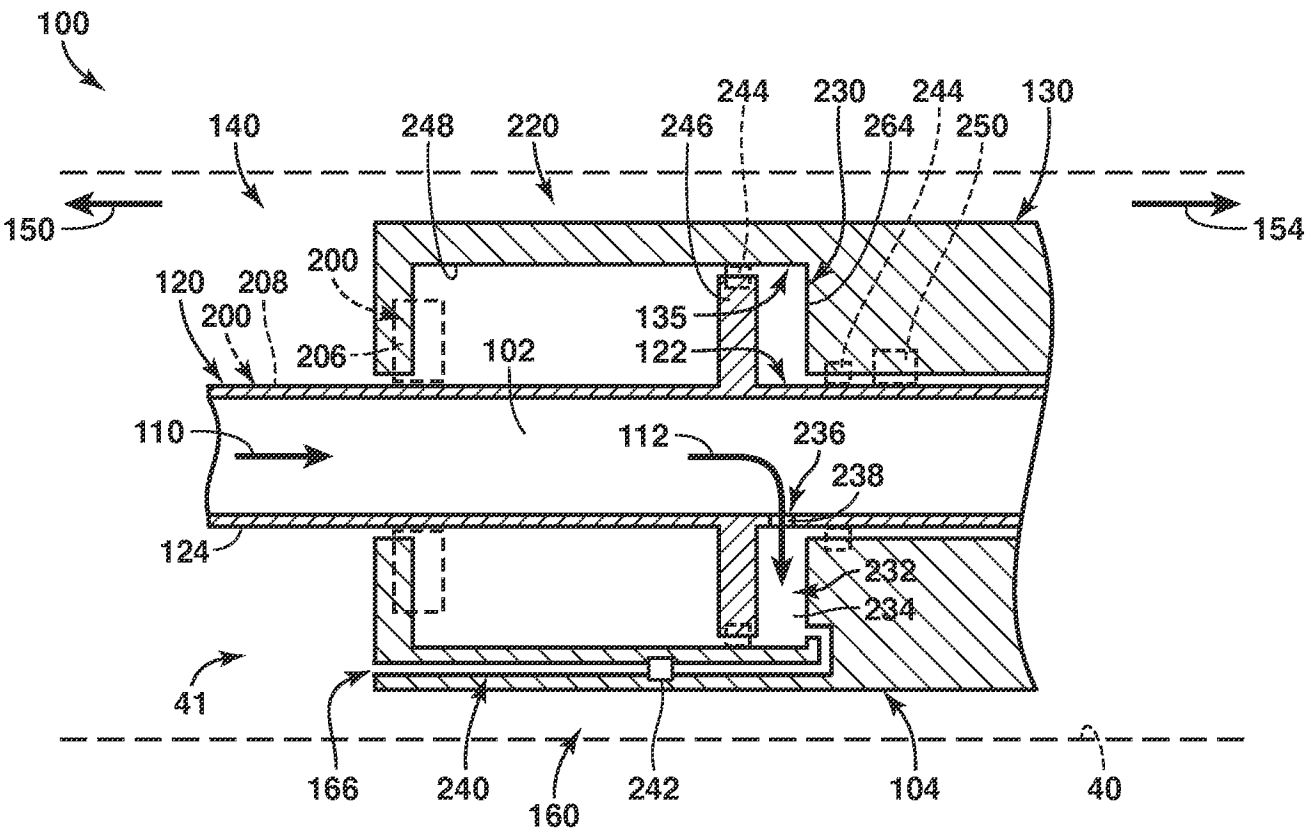
FIG. 11 is a less schematic longitudinal cross-sectional view of illustrative, non-exclusive examples of the downhole assembly of FIG. 9, wherein the fluid reservoir is being filled by transitioning from the contracted state to the expanded state.

Fluid reservoir 230 defines at least an expanded state and a contracted state, illustrative, non-exclusive examples of which are discussed in more detail herein, and may define an annular, or at least substantially annular, cross-sectional shape. FIGS. 6 and 9 illustrate fluid reservoir 230 in the expanded state, FIGS. 7 and 10 illustrate the fluid reservoir transitioning from the expanded state to the contracted state, and FIGS. 8 and 11 illustrate the fluid reservoir transitioning from the contracted sate to the expanded state.

As used herein, the phrases "expanded state" and "contracted state" are relative terms that may not, necessarily, refer to, include, and/or be discrete states of the fluid reservoir, such as respective fully expanded and/or fully contracted states of the fluid reservoir. Thus, it is within the scope of the present disclosure that the fluid reservoir may not be in the fully expanded state (i.e., fully filled with fluid and/or filled to maximum capacity with fluid) prior to transitioning to the contracted state. Additionally or alternatively, it is also within the scope of the present disclosure that the fluid reservoir may not be in the fully contracted state (i.e., fully emptied of fluid and/or emptied to minimum capacity) subsequent to and/or during transitioning to the contracted state. However, the expanded internal volume of the fluid reservoir is greater than the contracted internal volume of the fluid reservoir, thus providing for compression of the fluid that is contained therein and generation of the fluidizing stream when the fluid reservoir transitions from the expanded state to the contracted state.

In each of FIGS. 6-11, a fluid reservoir fill conduit 236 extends and provides fluid communication between fluid reservoir 230 and a drilling fluid conduit 102 that extends longitudinally within a first section 120 and a second section 130 of downhole assembly 100. The drilling fluid conduit provides fluid communication between a terminal end of the downhole assembly and a surface region (as discussed in more detail herein with reference to FIG. 1). In addition, a fluidizing stream conduit 240, which forms a portion of a fluidizing assembly 160, extends and provides fluid communication between fluid reservoir 230 and a region 41 that may be external to the downhole assembly, such as a wellbore that may contain downhole assembly 100 (as illustrated in FIGS. 1-3).

The downhole assemblies further include an energy-storing structure 200, illustrative, non-exclusive examples of which are discussed in more detail herein, that is configured to generate a motive force upon transitioning from a charged state to a discharged state. The motive force may be received by fluid reservoir 230, and the fluid reservoir may transition from the charged state to the discharged state responsive to and/or during receipt of the motive force. The downhole assembly also may include a release mechanism 250, illustrative, non-exclusive examples of which are discussed in more detail herein, that is configured to selectively control the transitioning of the energy-storing structure from the charged state to the discharged state.

In the illustrative, non-exclusive examples of FIGS. 6-11, a first portion 122 of fluid reservoir 230 is defined by a portion of first section 120 of downhole assembly 100, and a second portion 135 of fluid reservoir 230 is defined by a portion of second section 130 of the downhole assembly. First portion 122 of the fluid reservoir is configured to translate or otherwise move relative to second portion 135 of the fluid reservoir when the fluid reservoir transitions between the expanded state and the contracted state, thereby producing a compressing, squeezing, and/or syringe action that generates fluidization stream 170 (as illustrated in FIGS. 7 and 10).

It is within the scope of the present disclosure that first portion 122 and/or second portion 135 may include and/or be any suitable structure. As illustrative, non-exclusive examples, first portion 122 may define one of a piston 246 and a cylinder 248, and second portion 135 may define the other of the piston and the cylinder. When fluid reservoir 230 is defined by first portion 122 and second portion 135, and as illustrated in dashed lines, downhole assembly 100 further may include one or more sealing structures 244. Sealing structures 244 may be configured to contain volume 234 of fluid within fluid reservoir 230 and/or to restrict flow of the volume of fluid to flow through fluid reservoir fill conduit 236 and/or fluidizing stream conduit 240.

Fluid reservoir fill conduit 236 may include any suitable structure that is configured to permit flow of a portion 112 of drilling fluid stream 110 into fluid reservoir 230 when the fluid reservoir transitions from the contracted state to the expanded state, such as is illustrated in FIGS. 8 and 11. In addition, fluid reservoir fill conduit 236 also may include and/or be defined at least partially by a fill conduit flow control device 238.

Fill conduit flow control device 238 may be configured to permit a flow of drilling fluid 110 from drilling fluid conduit 102 into fluid reservoir 230 when the fluid reservoir transitions from the contracted state to the expanded state (such as is illustrated in FIGS. 8 and 11). In addition, fill conduit flow control device 238 also may be configured to resist a flow of volume 234 of fluid from the fluid reservoir and into the drilling fluid conduit, such as when the fluid reservoir transitions from the expanded state to the contracted state, as illustrated in FIGS. 7 and 10. An illustrative, non-exclusive example of a fill conduit flow control device 238 according to the present disclosure is a check valve, which may be referred to as a fill conduit check valve.

Similarly, fluidizing stream conduit 240 may include any suitable structure that is configured to permit flow of fluidizing stream 170 from fluid reservoir 230 to region 41 when the fluid reservoir transitions from the expanded state to the contracted state, such as is illustrated in FIGS. 7 and 10. In addition, fluidizing stream conduit 240 also may include and/or be defined at least partially by a fluidizing stream flow control device 242 and/or a fluidizing stream discharge orifice 166.

Fluidizing stream flow control device 242 may be configured to permit a flow of fluidizing stream 170 from fluid reservoir 230 into region 41 when the fluid reservoir transitions from the expanded state to the contracted state (as illustrated in FIGS. 7 and 10). In addition, fluidizing stream flow-control device 242 also may be configured to resist a flow of a fluid stream from region 41 and into the fluid reservoir, such as when the fluid reservoir transitions from the contracted state to the expanded state, as illustrated in FIGS. 8 and 11. An illustrative, non-exclusive example of fluidizing stream flow-control device 242 according to the present disclosure includes a check valve, which may be referred to as a fluidizing stream conduit check valve.

Fluidizing stream discharge orifice 166 may be defined by an external surface 104 of downhole assembly 100 and may include any suitable structure, illustrative, non-exclusive examples of which are discussed in more detail herein. As illustrated in FIGS. 6-11, the fluidizing stream discharge orifice may be located within and/or proximal to transition region 140 to permit injection of fluidization stream 170 into a cuttings bed that may be proximal thereto.

Release mechanism 250 may include any suitable structure that may be configured to retain energy-storing structure 200 in the charged state and to selectively permit the energy-storing structure to transition to the discharged state. Illustrative, non-exclusive examples of release mechanisms 250 according to the present disclosure are discussed in more detail herein.

As discussed, downhole assemblies 100 of FIGS. 6-11 include energy-storing structure 200, such as the energy-storing structures 200 that are described and/or illustrated herein. As illustrated in FIGS. 6-11, energy-storing structure 200 is shown in dashed lines to illustrate that the energy-storing structure may be present at any suitable location within the downhole assemblies and/or may include any suitable structure and/or form.

As an illustrative, non-exclusive example, and as indicated at 206, energy-storing structure 200 may be configured to apply the motive force to piston 246 when transitioned from the charged state to the discharged state. This may include expansion of a compressible energy-storing structure, such as a spring and/or a resilient member, and/or explosion of an explosive charge to supply the motive force to piston 246, thereby transitioning fluid reservoir 230 from the expanded state to the contracted state.

As another illustrative, non-exclusive example, and as indicated at 208, energy-storing structure 200 may be configured to apply the motive force to, and/or may be or include, a drill pipe 124 that forms a portion of first section 120. As an illustrative, non-exclusive example, drill pipe 124 may be placed in tension when downhole assembly 100 is conveyed in uphole direction 150 within the wellbore, and release mechanism 250 may be configured to release at least a portion of the tension on the drill pipe to generate the motive force. As another illustrative, non-exclusive example, drill pipe 124 may be compressed when downhole assembly 100 is conveyed in downhole direction 154 within the wellbore, and release mechanism 250 may be configured to release at least a portion of the compression on the drill pipe to generate the motive force.

FIGS. 6-8 illustrate a downhole assembly 100 according to the present disclosure that includes a fluid reservoir 230 that is configured to transition from the contracted state to the expanded state when first portion 120 of the downhole assembly is placed in compression. Such a fluid reservoir also may be referred to herein as a push-to-fill fluid reservoir 260 and/or as a fluid reservoir 260.

FIG. 6 illustrates fluid reservoir 260 in the expanded state. In this configuration, and when energy-storing structure 200 is in the charged state, the downhole assembly is ready, prepared, and/or primed to release the fluidizing stream therefrom. As an illustrative, non-exclusive example, and when downhole assembly 100 is conveyed within a wellbore in uphole direction 150, drag forces on the downhole assembly, such as on transition region 140 and/or second section 130 thereof, may generate an axial force within first section 120 that may include and/or be a tensile axial force. When this axial force exceeds a threshold axial force and/or a threshold tensile axial force, energy-storing storing structure 200 may transition from the charged state to the discharged state, thereby transitioning fluid reservoir 260 from the expanded state to the contracted state, as illustrated in FIG. 7.

As another illustrative, non-exclusive example, and when downhole assembly 100 is conveyed within the wellbore in downhole direction 154, drag forces on the downhole assembly may generate an axial force within first section 120 that may include and/or be a compressive axial force. When this axial force exceeds a threshold axial force and/or a threshold compressive axial force, energy-storing structure 200 may transition from the charged state to the discharged state, thereby transitioning fluid reservoir 260 from the expanded state to the contracted state, as illustrated in FIG. 7.

When the fluid reservoir contracts by transitioning from the expanded state to the contracted state, the fluid contained within internal volume 232 may be pressurized. This may generate fluidizing stream 170, which may be emitted from fluidizing assembly 160 into region 41 (which may be a portion of a wellbore that includes a cuttings bed and/or a cuttings dune, as illustrated in FIGS. 1-3).

Subsequent to the fluid reservoir being contracted, downhole assembly 106 may be conveyed in downhole direction 154. This may place first section 120 in compression, which may charge energy-storing structure 200 and/or expand fluid reservoir 260 by transitioning the fluid reservoir from the contracted state to the expanded state, as illustrated in FIG. 8. As the fluid reservoir expands, portion 112 of drilling fluid stream 110 may flow thereinto through fluid reservoir fill conduit 236, thereby filling the fluid reservoir with fluid and returning the fluid reservoir to the expanded state, as illustrated in FIG. 6.

In contrast, FIGS. 9-11 illustrate a downhole assembly 100 according to the present disclosure that includes a fluid reservoir 230 that is configured to transition from the contracted state to the expanded state when first portion 120 of the downhole assembly is placed in tension. Such a fluid reservoir also may be referred to herein as a pull-to-fill fluid reservoir 264 and/or as a fluid reservoir 264.

FIG. 9 illustrates fluid reservoir 264 of downhole assembly 100 in the expanded state. In this configuration, and when energy-storing structure 200 is in the charged state, the downhole assembly is ready, prepared, and/or primed to release the fluidizing stream therefrom. As an illustrative, non-exclusive example, and when downhole assembly 100 is conveyed within a wellbore in downhole direction 154, drag forces on the downhole assembly may generate an axial force within first section 120 that may include and/or be a compressive axial force. When this axial force exceeds a threshold axial force and/or a threshold compressive axial force, energy-storing structure 200 may transition from the charged state to the discharged state, thereby transitioning fluid reservoir 264 from the expanded state to the contracted state, as illustrated in FIG. 10.

As another illustrative, non-exclusive example, and when downhole assembly 100 is conveyed within the wellbore in uphole direction 150, drag forces on the downhole assembly may generate an axial force within first section 120 that may include and/or be a tensile axial force. When this axial force exceeds a threshold axial force and/or a threshold tensile axial force, energy-storing structure 200 may transition from the charged state to the discharged state, thereby transitioning fluid reservoir 264 from the expanded state the contracted state, as illustrated in FIG. 10. When the fluid reservoir contracts by transitioning from the expanded state to the contracted state, the fluid contained within internal volume 232 may be pressurized. This may generate fluidizing stream 170, which may be emitted from fluidizing assembly 160 into region 41.

Subsequent to the reservoir being contracted, downhole assembly 100 may be conveyed in uphole direction 150. This may place first section 120 in tension, which may charge energy-storing structure 200 and/or expand fluid reservoir 264, thereby transitioning the fluid reservoir from the contracted state to the expanded state, as illustrated in FIG. 11. As the fluid reservoir expands, portion 112 of drilling fluid stream 110 may flow thereinto through fluid reservoir fill conduit 236, thereby filling the fluid reservoir with fluid and returning the fluid reservoir to the expanded state, as illustrated in FIG. 9.

FIGS. 6-8 illustrate downhole assembly 100 as including a single push-to-fill fluid reservoir 260, while FIGS. 7-11 illustrate downhole assembly 100 as including a single pull-to-fill fluid reservoir 264. However, downhole assemblies 100 according to the present disclosure may include any suitable number of fluid reservoirs 230 including any suitable number of push-to-fill fluid reservoirs 260 and/or any suitable number of pull-to-fill fluid reservoirs 264, as well as any suitable number of associated energy-storing structures 200.

As illustrative, non-exclusive examples, downhole assemblies 100 may include 1, 2, 3, 4, 5, or more than 5 push-to-fill fluid reservoirs 260. Additionally or alternatively, downhole assemblies 100 may include 1, 2, 3, 4, 5, or more than 5 pull-to-fill fluid reservoirs 264. This is illustrated schematically in FIG. 1 by the presence of multiple dashed lead lines for reference numerals 260 and 264.

When downhole assemblies 100 include a plurality of fluid reservoirs 230, it is within the scope of the present disclosure that at least one of the plurality of fluid reservoirs may be configured to transition from the expanded state to the contracted state responsive to a different axial force than at least one other of the plurality of fluid reservoirs. As an illustrative, non-exclusive example, a first fluid reservoir of the plurality of fluid reservoirs may be configured to transition from the expanded state to the contracted state responsive to a compressive force being applied to first section 120, while a second fluid reservoir of the plurality of fluid reservoirs may be configured to transition from the expanded state to the contracted state responsive to a tensile force being applied to first section 120.

In addition, and while FIGS. 1-3 and 6-11 illustrate fluidizing assembly 160 as emitting fluidizing stream 170 in, near, and/or proximal to transition region 140, it is within the scope of the present disclosure that the fluidization stream may be emitted from any suitable portion, region, and/or surface of downhole assembly 100. As illustrative, non-exclusive examples, the fluidization stream may be emitted from and/or proximal to first section 120, second section 130, transition region 140, and/or terminal end 138 (as illustrated in FIGS. 1-2).

Figure 12:
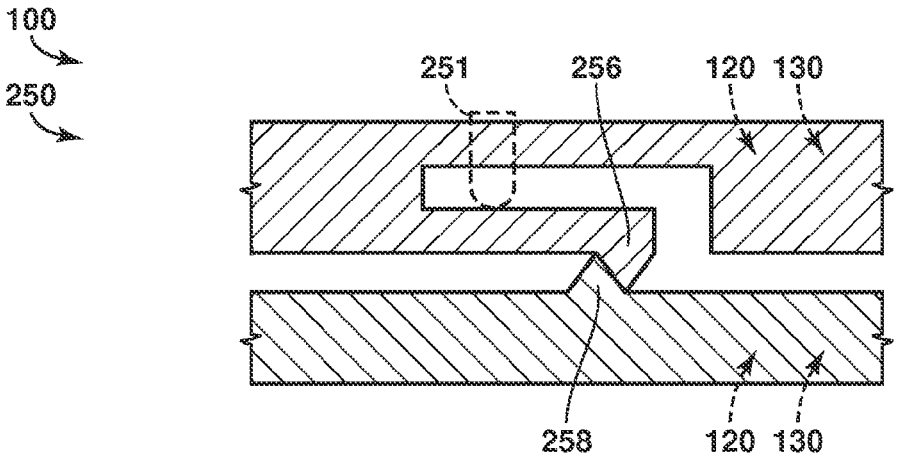
FIG. 12 is a schematic longitudinal cross-sectional view of illustrative, non-exclusive examples of a release mechanism that may be utilized with the systems and methods according to the present disclosure in a retaining state.
Figure 13:
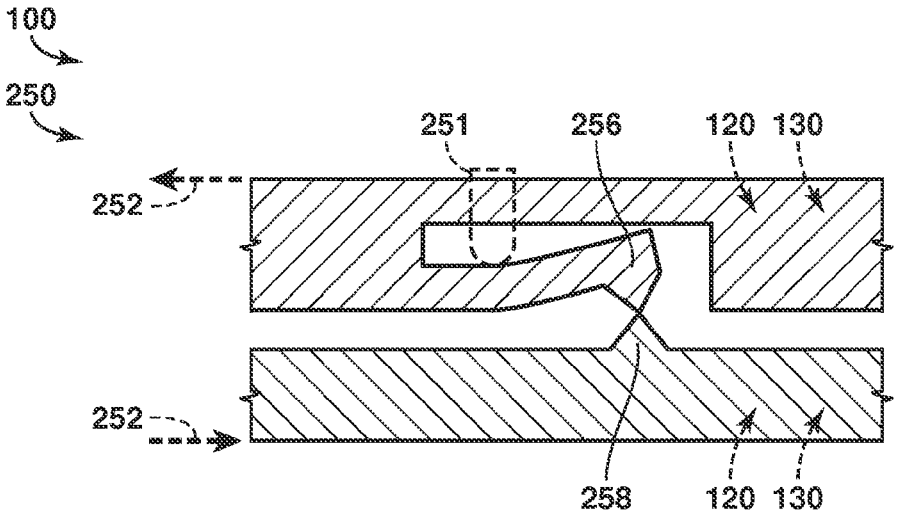
FIG. 13 is a schematic longitudinal cross-sectional view of illustrative, non-exclusive examples of a release mechanism that may be utilized with the systems and methods according to the present discourse in a released state.

FIGS. 12-13 are schematic longitudinal cross-sectional views of illustrative, non-exclusive examples of a release mechanism 250 according to the present disclosure. FIG. 12 illustrates the release mechanism in a retaining state, while FIG. 13 illustrates the release mechanism transitioning to a released state. In the illustrative, non-exclusive example of FIGS. 12-13, release mechanism 250 includes a spring-loaded hook 256 and a collar 258, which also may be referred to herein as a spring-loaded latch, where hook 256 is configured to engage collar 258.

Release mechanism 250 is a passive release mechanism that is configured to transition from the retaining state to the released state, and thereby permit energy-storing structure 200 of FIGS. 5-11 to transition from the charged state to the discharged state, directly responsive to application of an axial force 252 that exceeds a threshold axial force to a portion of the downhole assembly. As an illustrative, non-exclusive example, one of hook 256 and collar 258 may be operatively attached to and/or form a portion of first section 120 of downhole assembly 100, while the other of hook 256 and collar 258 may be operatively attached to and/or form a portion of second section 130 of the downhole assembly.

Under these conditions, application of an axial force 252 that exceeds the threshold axial force to first section 120 may cause the release mechanism to transition from the retaining state to the released state. Additionally or alternatively, reversing the axial force may cause the release mechanism to transition from the released state to the retaining state.

As illustrated in dashed lines in FIGS. 12-13, release mechanism 250 also may include an adjusting screw 251. Adjusting screw 251 may be configured to bear against and/or apply a force to spring-loaded hook 256, thereby changing a magnitude of axial force 252 that is needed to transition the release mechanism between the retaining state and the released state.

Figure 14:
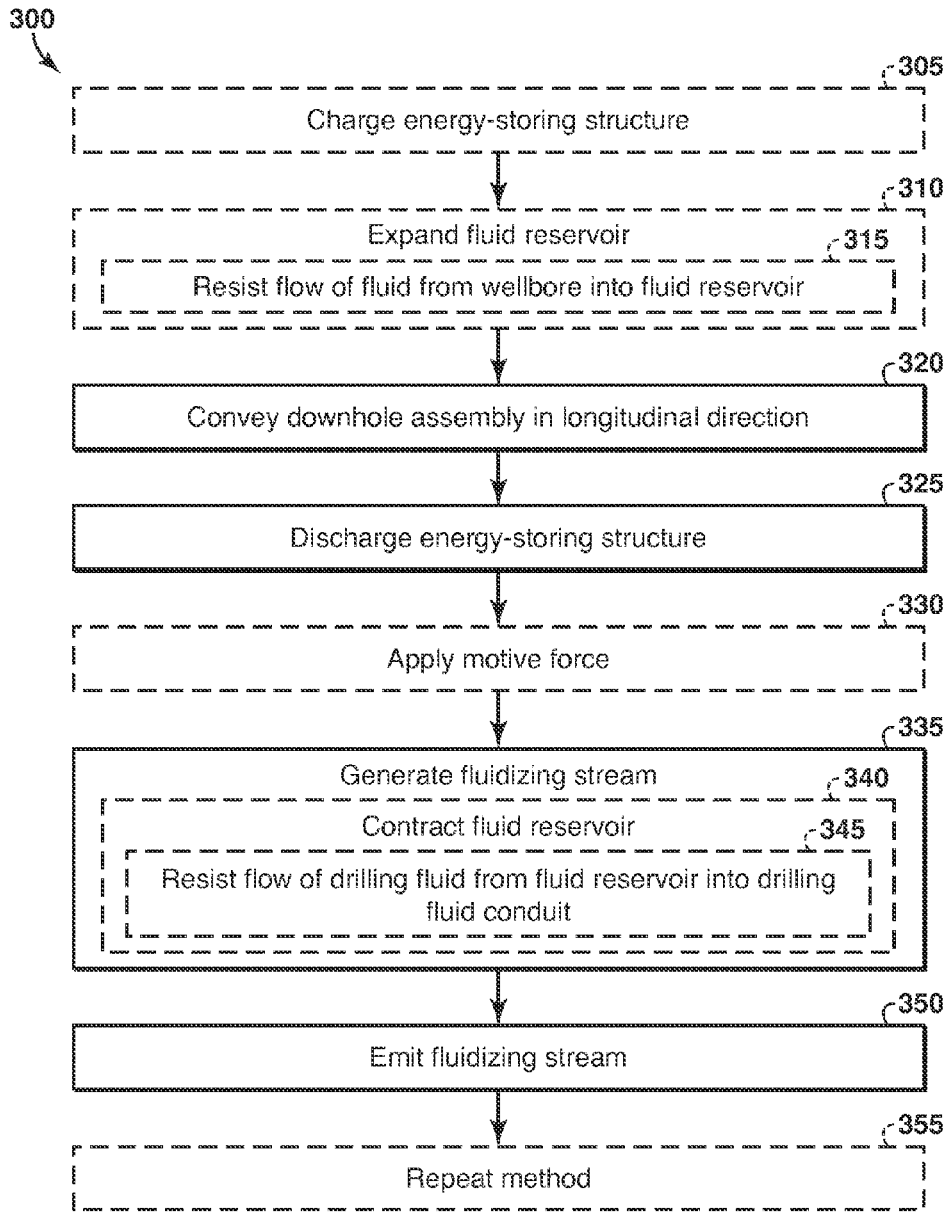
FIG. 14 is a flowchart depicting methods according to the present disclosure of fluidizing a cuttings bed.

FIG. 14 is a flowchart depicting methods 300 according to the present disclosure of fluidizing a cuttings bed. Methods 300 may include charging an energy-storing structure at 305 and/or expanding a fluid reservoir at 310. Methods 300 may further include conveying a downhole assembly in a longitudinal direction within a wellbore at 320 and discharging an energy-storing structure at 325. Methods 300 still further may include applying a motive force at 330, include generating a fluidizing stream at 335 and emitting the fluidizing stream at 350, and may include repeating at least a portion of the methods at 355.

The downhole assembly may include an energy-storing structure that defines at least a charged state and a discharged state, and charging the energy-storing structure at 305 may include transitioning the energy-storing structure from the discharged state to the charged state. As an illustrative, non-exclusive example, the charging may include compressing a resilient member, compressing a spring, placing a portion of a drill string in tension, placing a portion of a drill string in compression, and/or compressing a gas. As another illustrative, non-exclusive example, the charging at 305 may include conveying the downhole assembly in a longitudinal direction within the wellbore to generate an axial force within a portion of the downhole assembly, with the axial force bringing about, contributing to, and/or producing the charging at 305.

Expanding the fluid reservoir at 310 may include transitioning the fluid reservoir from a contracted state to an expanded state to increase an internal volume of the fluid reservoir. As an illustrative, non-exclusive example, the expanding at 310 may be performed currently and/or cooperatively with the charging at 305. As another illustrative, non-exclusive example, the expanding at 310 may include conveying the downhole assembly in a longitudinal direction within the wellbore to generate an axial force within a portion of the downhole assembly, with the axial force bringing about, contributing to, and/or producing the expanding at 310.

It is within the scope of the present disclosure that the expanding at 310 further may include filling the fluid reservoir, or the internal volume thereof, with any suitable fluid, such as a drilling fluid and/or a wellbore fluid. As an illustrative, non-exclusive example, a drilling fluid conduit may extend within the downhole assembly, and the expanding may include filling the fluid reservoir with drilling fluid from the drilling fluid conduit, such as via a fluid reservoir fill conduit that provides fluid communication between the drilling fluid conduit and the fluid reservoir.

In addition, and as indicated in FIG. 14 at 315, the expanding at 310 further may include resisting a flow of a fluid from the wellbore into the fluid reservoir. As illustrative, non-exclusive examples, the resisting at 315 may include resisting with a check valve and/or resisting during the expanding at 310.

Conveying the downhole assembly in the longitudinal direction within the wellbore at 320 may include conveying the downhole assembly in an uphole direction and/or conveying the downhole assembly in a downhole direction. Additionally or alternatively, the conveying at 320 also may include generating an axial force within a portion of the downhole assembly. As an illustrative, non-exclusive example, and as discussed, the wellbore may include a cuttings bed that may resist motion of the downhole assembly therethrough. Under these conditions, conveying the downhole assembly in the downhole direction may generate a compressive force in at least a portion of the downhole assembly (such as a first, or uphole portion of the downhole assembly), and conveying the downhole assembly in the uphole direction may generate a tensile force in the portion of the downhole assembly.

It is within the scope of the present disclosure that the conveying at 320 may include conveying the downhole assembly in a first longitudinal direction (such as one of the uphole direction and the downhole direction) and that the charging at 305 and/or the expanding at 310 may include conveying the downhole assembly in a second longitudinal direction that is different from the first longitudinal direction (such as the other of the uphole direction and the downhole direction). As an illustrative, non-exclusive example, and when the downhole assembly includes a push-to-fill reservoir, the conveying at 320 may include conveying the downhole assembly in the uphole direction, while the charging at 305 and/or the expanding at 310 may include conveying the downhole assembly in the downhole direction. However, it is also within the scope of the present disclosure that the conveying at 320 may include conveying the downhole assembly in a selected longitudinal direction (such as one of the uphole direction and the downhole direction) and that the charging at 305 and/or the expanding at 310 also may include conveying the downhole assembly in the selected longitudinal direction.

Discharging the energy-storing structure at 325 may include transitioning the energy-storing structure from the charged state to the discharged state to yield, produce, and/or generate a motive force. As an illustrative, non-exclusive example, the discharging at 325 may include discharging responsive to an axial force that is present within a portion of the downhole assembly (and may be generated by the conveying at 320) exceeding a threshold axial force. This may include a tensile force that exceeds a threshold tensile force (such as when the downhole assembly is conveyed in the uphole direction) and/or a compressive force that exceeds a threshold compressive force (such as when the downhole assembly is conveyed in the downhole direction).

As an illustrative, non-exclusive example, and subsequent to the charging at 305, the discharging at 325 may include decompressing the resilient member, decompressing the spring, releasing at least a portion of the tension from the portion of the drill string, releasing at least a portion of the compression from the portion of the drill string, and/or decompressing the gas to generate the motive force. As another illustrative, non-exclusive example, the discharging at 325 may include exploding an explosive charge to generate the motive force.

As discussed herein, the downhole assembly may include a release mechanism that is configured to retain the energy-storing structure in the charged state and to selectively permit the energy-storing structure to transition to the discharged state, thereby generating the motive force, responsive to the axial force exceeding the threshold axial force. Thus, methods 300 further may include maintaining the energy-storing structure in the charged state with the release mechanism subsequent to the charging at 305 and prior to the discharging at 325.

As also discussed, the release mechanism may include any suitable release mechanism, including any suitable active and/or passive release mechanism. When the release mechanism includes an active release mechanism, the discharging at 325 may include initiating the discharging by actuating the active release mechanism. Additionally or alternatively, and when the release mechanism includes a passive release mechanism, the discharging at 325 may include automatically initiating the discharging with the release mechanism, such as by transitioning the release mechanism from a retaining state to a released state, responsive to the axial force exceeding the threshold axial force.

Applying the motive force at 330 may include applying the motive force to any suitable fluid propulsion device, which may generate the fluidizing stream therefrom, as discussed in more detail herein with reference to the generating at 335. This may include applying the motive force via any suitable linkage. As illustrative, non-exclusive examples, the applying at 330 may include applying the motive force to the fluid reservoir, to a pump, and/or to a turbine.

Generating the fluidizing stream at 335 may include generating the fluidizing stream with the motive force and/or generating the fluidizing stream responsive to receipt of the motive force by the fluid propulsion device. As an illustrative, non-exclusive example, and when the fluid propulsion device includes a pump and/or a turbine, the generating at 335 may include powering the pump and/or the turbine with the motive force.

As another illustrative, non-exclusive example, and when the fluid propulsion device includes and/or is the fluid reservoir, the generating at 335 may include contracting the fluid reservoir at 340 responsive to receipt of the motive force by the fluid reservoir. The contracting at 340 may include transitioning the fluid reservoir from the expanded state to the contracted state, thereby pressurizing the volume of fluid that is contained within the internal volume thereof to generate the fluidizing stream.

It is within the scope of the present disclosure that the contracting at 340 further may include resisting a flow of the volume of fluid that is contained within the fluid reservoir from the fluid reservoir into the drilling fluid conduit at 345. This may include resisting with an inflow check valve that may be located within and/or define a portion of the fluid reservoir fill conduit.

Emitting the fluidizing stream at 350 may include emitting the fluidizing stream from the downhole assembly and/or emitting the fluidizing stream to fluidize a portion of the cuttings bed that is proximal to the fluidizing assembly within the wellbore. As an illustrative, non-exclusive example, the emitting at 350 may include emitting the fluidizing stream into a portion (such as portion 41) of the wellbore that is proximate to the transition region of the downhole assembly. As another illustrative, non-exclusive example, the emitting at 350 may include increasing a local pressure within the portion of the cuttings bed and/or decreasing a solid-solid shear stress within the portion of the cuttings bed to fluidize, or at least partially fluidize, the portion of the cuttings bed.

It is within the scope of the present disclosure that the emitting at 350 may include selectively emitting the fluidizing stream into a portion of the wellbore that includes the portion of the cuttings bed and/or selectively restricting the flow of the fluidizing stream such that it is not emitted into a portion of the wellbore that does not include the portion of the cuttings bed. Additionally or alternatively, the emitting at 350 also may include selectively controlling an orientation of the fluidizing assembly and/or a fluidizing stream discharge orifice thereof to direct the fluidizing stream into the portion of the cuttings bed.

Repeating at least a portion of the methods at 355 may include repeating any suitable portion of the methods and/or repeating without damage to the downhole assembly and/or to any suitable component thereof. As an illustrative, non-exclusive example, the repeating at 355 may include repeating at least the charging at 305, the discharging at 325, and the generating at 335 a plurality of times during the conveying at 320 to emit the fluidizing stream from the downhole assembly a respective plurality of times at 350. Additionally or alternatively, the repeating at 355 also may include repeating the expanding at 310, the contracting at 340, and the generating at 335 a plurality of times during the conveying at 320 to emit the fluidizing stream from the downhole assembly a respective plurality of times at 350.

As an illustrative, non-exclusive example, and during the conveying at 320, formation of a cuttings dune may produce a packoff event, which may cause the axial force to exceed the threshold axial force. Responsive to the axial force exceeding the threshold axial force, the downhole assembly may perform the discharging at 325, which may provide the motive force for the generating at 335, with the generated fluidizing stream being emitted from the downhole assembly at 350. However, the emitted fluidizing stream may be insufficient to fluidize, or completely fluidize, the cuttings dune and/or to sufficiently fluidize a sufficient portion of the cuttings bed for a sufficient period of time for the downhole assembly to be moved along the wellbore to mitigate and/or eliminate the packoff event. Thus, in some applications the packoff event may persist despite proper operation of the systems and/or methods. Under these conditions, the repeating at 355 may include emitting a plurality of fluidizing streams at 350 until the cuttings dune is at least partially fluidized, until the cuttings dune is completely fluidized, and/or until the downhole assembly is freed from the packoff event.

As another illustrative, non-exclusive example, and during the conveying at 320, a plurality of discrete, individual, independent, and/or separate cuttings dunes may form at a plurality of spaced-apart locations within the wellbore, with at least a portion of these discrete cuttings dunes producing discrete packoff events. Thus, the repeating at 355 may include repeating any suitable portion of methods 300 to repeat the emitting at 350 responsive to each discrete packoff event.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C"

may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, programmed, utilized, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A method of fluidizing a cuttings bed, the method comprising:

conveying a downhole assembly in a longitudinal direction within a wellbore, wherein the downhole assembly includes an energy-storing structure that defines at least a charged state and a discharged state, and further wherein the conveying includes generating an axial force within a portion of the downhole assembly;

discharging the energy-storing structure by transitioning from the charged state to the discharged state to generate a motive force, wherein the discharging is responsive to the axial force exceeding a threshold axial force;

generating a fluidizing stream with the motive force; and emitting the fluidizing stream from the downhole assembly to fluidize a portion of the cuttings bed.

A2. The method of paragraph A1, wherein, prior to the discharging, the method further includes charging the energy-storing structure by transitioning the energy-storing structure from the discharged state to the charged state.

A3. The method of paragraph A2, wherein the conveying includes conveying the downhole assembly in a first longitudinal direction, wherein the charging includes conveying the downhole assembly in a second longitudinal direction that is opposed to the first longitudinal direction, optionally wherein the first longitudinal direction includes one of an uphole direction and a downhole direction, and further optionally wherein the second longitudinal direction includes the other of the uphole direction and the downhole direction.

A4. The method of paragraph A3, wherein the charging includes at least one of compressing a resilient member, compressing a spring, and compressing a gas, and further wherein the discharging includes at least one of releasing the resilient member, releasing the spring, and decompressing the gas.

A5. The method of any of paragraphs A2-A4, wherein the conveying includes conveying the downhole assembly in a selected longitudinal direction, wherein the charging includes conveying the downhole assembly in the selected longitudinal direction, and optionally wherein the selected longitudinal direction includes one of an uphole direction and a downhole direction.

A6. The method of paragraph A5, wherein the charging includes at least one of compressing a resilient member, compressing a spring, compressing a gas, placing a portion of a drill string in compression, and placing the portion of a drill string in tension, and further wherein the discharging includes at least one of releasing the resilient member, releasing the spring, decompressing the gas, and releasing the tension on the drill string.

A7. The method of any of paragraphs A2-A6, wherein the method further includes repeating the charging and the discharging the energy-storing structure a plurality of times to emit the fluidizing stream from the downhole assembly a respective plurality of times.

A8. The method of paragraph A7, wherein the repeating the charging and the discharging the energy-storing structure includes repeating the charging and the discharging without damage to the energy-storing structure.

A9. The method of any of paragraphs A1-A8, wherein the energy-storing structure includes an explosive charge, and further wherein the discharging includes exploding the explosive charge to provide a motive force for the generating.

A10. The method of any of paragraphs A1-A9, wherein the downhole assembly includes a fluid reservoir that defines at least an expanded state that defines an expanded internal volume and a contracted state that defines a contracted internal volume, wherein the expanded internal volume is greater than the contracted internal volume, and further wherein the generating includes contracting the fluid reservoir by transitioning the fluid reservoir from the expanded state to the contracted state to generate the fluidizing stream.

A11. The method of paragraph A10, wherein the method further includes applying the motive force to the fluid reservoir, and further wherein the contracting the fluid reservoir is responsive to receipt of the motive force by the fluid reservoir.

A12. The method of any of paragraphs A10-A11, wherein, prior to the contracting, the method further includes expanding the fluid reservoir by transitioning the fluid reservoir from the contracted state to the expanded state.

A13. The method of paragraph A12, wherein the conveying includes conveying the downhole assembly in a/the first longitudinal direction, wherein the expanding includes conveying the downhole assembly in a/the second longitudinal direction that is opposed to the first longitudinal direction, optionally wherein the first longitudinal direction includes one of an/the uphole direction and a/the downhole direction, and further optionally wherein the second longitudinal direction includes the other of the uphole direction and the downhole direction.

A14. The method of paragraph A12, wherein the conveying includes conveying the downhole assembly in a/the selected longitudinal direction, wherein the expanding includes conveying the downhole assembly in the selected longitudinal direction, and optionally wherein the selected longitudinal direction includes one of an/the uphole direction and a/the downhole direction.

A15. The method of any of paragraphs A12-A14, wherein the expanding includes filling the fluid reservoir with a drilling fluid.

A16. The method of paragraph A15, wherein a drilling fluid conduit extends within the downhole assembly and between a surface region and the fluid reservoir, and further wherein the expanding includes filling the fluid reservoir with drilling fluid from the drilling fluid conduit.

A17. The method of paragraph A16, wherein the method further includes resisting a flow of the drilling fluid from the fluid reservoir into the drilling fluid conduit, and optionally wherein the resisting includes resisting with an inflow check valve.

A18. The method of any of paragraphs A12-A17, wherein the method further includes repeating the expanding and the contracting a plurality of times to emit the fluidizing stream from the downhole assembly a respective plurality of times.

A19. The method of paragraph A18, wherein the repeating includes repeating without damage to the fluid reservoir.

A20. The method of any of paragraphs A12-A19, wherein the method further includes resisting a flow of a fluid from the wellbore into the fluid reservoir, optionally wherein the resisting includes resisting with an outflow check valve, and further optionally wherein the resisting includes resisting during the expanding.

A21. The method of any of paragraphs A1-A20, wherein the downhole assembly further includes a release mechanism.

A22. The method of paragraph A21, wherein the release mechanism includes a passive release mechanism, and further wherein the method includes automatically initiating the discharging with the release mechanism responsive to the axial force exceeding the threshold axial force.

A23. The method of any of paragraphs A21-A22, wherein the release mechanism includes an active release mechanism, and further wherein the method includes initiating the discharging by actuating the release mechanism.

A24. The method of any of paragraphs A21-A22 when dependent from paragraph A2, wherein the method further includes maintaining the energy-storing structure in the charged state with the release mechanism subsequent to the charging and prior to the discharging.

A25. The method of any of paragraphs A1-A24, wherein the downhole assembly includes a first section that has a first cross-sectional area and a second section that is closer to a terminal end of the downhole assembly than the first section and has a second cross-sectional area that is greater than the first cross-sectional area.

A26. The method of paragraph A25, wherein the first section includes at least one of a drill string and a drill pipe.

A27. The method of any of paragraphs A25-A26, wherein the first section is configured to provide fluid and mechanical communication between a surface region and the second section.

A28. The method of any of paragraphs A25-A27, wherein the second section includes at least one of a bottom-hole assembly and a drill collar.

A29. The method of any of paragraphs A25-A28, wherein the second section is configured to selectively contact a terminal end of the wellbore and produce cuttings to increase a length of the wellbore.

A30. The method of any of paragraphs A25-A29, wherein the first cross-sectional area is measured transverse to a longitudinal axis of the first section.

A31. The method of any of paragraphs A25-A30, wherein the second cross-sectional area is measured transverse to a longitudinal axis of the second section.

A32. The method of any of paragraphs A25-A31, wherein a ratio of the second cross-sectional area to the first cross-sectional area is at least 1.1:1, optionally including ratios of at least 1.2:1, 1.3:1, 1.4:1, 1.5:1, 1.6:1, 1.7:1, 1.8:1, 1.9:1, 2:1, 2.25:1, 2.5:1, 3:1, 4:1, or at least 5:1, and further optionally including ratios of between 1.1:1 and 2:1, between 1.5:1 and 3:1, or between 1.5:1 and 5:1.

A33. The method of any of paragraphs A25-A31, wherein the downhole assembly further includes a transition region between the first section and the second section.

A34. The method of paragraph A33, wherein the transition region operatively attaches the first section to the second section.

A35. The method of any of paragraphs A33-A34, wherein the emitting includes emitting into the wellbore proximate the transition region.

A36. The method of any of paragraphs A1-A35, wherein the emitting includes increasing a local pressure within the portion of the cuttings bed.

A37. The method of any of paragraphs A1-A36, wherein the emitting includes decreasing a solid-solid shear stress within the portion of the cuttings bed.

A38. The method of any of paragraphs A1-A37, wherein the emitting includes selectively emitting the fluidizing stream into a portion of the wellbore that includes the portion of the cuttings bed.

A39. The method of any of paragraphs A1-A38, wherein the emitting further includes selectively controlling an orientation of a/the fluidizing stream discharge orifice to direct the fluidizing stream into the portion of the cuttings bed.

A40. The method of any of paragraphs A1-A39, wherein the portion of the cuttings bed includes a portion of the cuttings bed that is within 4 meters of the transition region, optionally including a portion of the cuttings bed that is within 3.5 meters, within 3 meters, within 2.5 meters, within 2 meters, within 1.5 meters, within 1 meter, within 0.75 meters, within 0.5 meters, within 0.25 meters, within 0.2 meters, within 0.15 meters, within 0.1 meters, or within 0.05 meters of the transition region.

B1. A downhole assembly configured to be conveyed within a wellbore, the downhole assembly comprising:

means for producing a motive force;

means for generating a fluidizing stream with the motive force; and means for emitting the fluidizing stream from the downhole assembly and providing the fluidizing stream to a cuttings bed to fluidize a portion of the cuttings bed.

B2. The assembly of paragraph B1, wherein the means for producing includes an energy-storing structure that defines at least a charged state and a discharged state and which is configured to be discharged and generate the motive force by transitioning from the charged state to the discharged state.

B3. The assembly of any of paragraphs B1-B2, wherein the means for generating includes generating the fluidizing stream responsive to an axial force within a portion of the downhole assembly exceeding a threshold axial force.

B4. The assembly of any of paragraphs B1-B3, wherein the means for generating includes a fluid propulsion device that is configured to receive the motive force from the means for producing and to generate the fluidizing stream therefrom.

B5. The assembly of any of paragraphs B1-B4, wherein the means for emitting includes a fluidizing assembly that is configured to emit the fluidizing stream from the downhole assembly and to provide the fluidizing stream to the cuttings bed to fluidize the portion of the cuttings bed.

C1. A downhole assembly configured to be conveyed within a wellbore, the downhole assembly comprising:

an energy-storing structure that defines at least a charged state and a discharged state and which is configured to be discharged and generate a motive force by transitioning from the charged state to the discharged state;

a fluid propulsion device that is configured to receive the motive force from the energy-storing structure and to generate a fluidizing stream therefrom; and a fluidizing assembly that is configured to emit the fluidizing stream from the downhole assembly and provide the fluidizing stream to a cuttings bed to fluidize a portion of the cuttings bed.

C2. The assembly of any of paragraphs B2-C1, wherein, in the charged state, the energy-storing structure stores a quantity of energy, and further wherein, in the discharged state, the energy-storing structure does not store the quantity of energy.

C3. The assembly of paragraph C2, wherein the quantity of energy includes at least one of a quantity of potential energy, a quantity of mechanical energy, quantity of pneumatic energy, and a quantity of chemical energy.

C4. The assembly of any of paragraphs B2-C3, wherein the energy-storing structure includes at least one of a mechanical energy-storing structure, a resilient member, a spring, a chemical compound, an explosive charge, a surface assembly, a drill pipe, a captured volume of gas, and a compressed volume of gas.

C5. The assembly of any of paragraphs B2-C4, wherein the energy-storing structure is configured to transition from the charged state to the discharged state in less than 10 seconds, less than 8 seconds, less than 6 seconds, less than 4 seconds, less than 2 seconds, less than 1 second, or less than 0.5 seconds.

C6. The assembly of any of paragraphs B2-C5, wherein the energy-storing structure is further configured to generate an axial force on the downhole assembly by transitioning from the charged state to the discharged state, and optionally wherein the axial force includes a jarring force.

C7. The assembly of any of paragraphs B2-C6, wherein the energy-storing structure is configured to be repeatedly transitioned between the charged state and the discharged state without damage to the energy-storing structure.

C8. The assembly of any of paragraphs B2-C7, wherein the downhole assembly further includes a release mechanism.

C9. The assembly of paragraph C8, wherein the release mechanism is configured to selectively control the discharging.

C10. The assembly of paragraph C9, wherein the release mechanism includes a resettable release mechanism.

C11. The assembly of any of paragraphs C9-C10, wherein the release mechanism is configured to selectively control the discharging at least a plurality of times without damage to the release mechanism.

C12. The assembly of any of paragraphs C8-C11, wherein the release mechanism is configured to retain the energy-storing structure in the charged state and to selectively permit the energy-storing structure to transition to the discharged state responsive to at least one of: (i) application of a tensile force to a portion of the downhole assembly that is greater than a threshold tensile force; (ii) application of a compressive force to the portion of the downhole assembly that is greater than a threshold compressive force; and (iii) application of an axial force to the portion of the downhole assembly that is greater than a threshold axial force.

C13. The assembly of paragraph C12, wherein the downhole assembly further includes a detector that is configured to detect the axial force, optionally wherein the release mechanism is configured to permit the energy-storing structure to transition from the charged state to the discharged state responsive to detecting that the axial force is the tensile force that is greater than the threshold tensile force, and further optionally wherein the release mechanism is configured to permit the energy-storing structure to transition from the charged state to the discharged state responsive to detecting that the axial force is the compressive force that is greater than the threshold compressive force.

C14. The assembly of any of paragraphs C12-C13, wherein the portion of the downhole assembly includes at least one of a/the first section of the drilling assembly, a second section of the drilling assembly, a drill pipe, bottom hole assembly, a drill string, and a drill bit.

C15. The assembly of any of paragraphs C8-C14, wherein the release mechanism includes an adjustable release mechanism.

C16. The assembly of any of paragraphs C8-C15, wherein the release mechanism includes a passive release mechanism.

C17. The assembly of paragraph C16, wherein the passive release mechanism includes a spring-loaded passive release mechanism, optionally wherein the passive release mechanism includes a spring-loaded latch.

C18. The assembly of any of paragraphs C16-C17, wherein the passive release mechanism includes a hook and collar, and optionally wherein the hook is operatively attached to one of a/the first section of the downhole assembly and a/the second section of the downhole assembly and the collar is operatively attached to the other of the first section of the downhole assembly and the second section of the downhole assembly.

C19. The assembly of any of paragraphs C8-C18, wherein the release mechanism includes an active release mechanism.

C20. The assembly of paragraph C19, wherein the active release mechanism includes at least one of a hydraulically actuated active release mechanism, an electrically actuated active release mechanism, and a mechanically actuated active release mechanism.

C21. The assembly of any of paragraphs C19-C20, wherein the active release mechanism is configured to be actuated from a surface region.

C22. The assembly of any of paragraphs B2-C21, wherein the downhole assembly further includes a fluid reservoir that defines an internal volume, wherein the fluid reservoir is configured to retain a volume of fluid within the internal volume when the energy-storing structure is in the charged state and to expel the volume of fluid from the internal volume as the fluidizing stream while the energy-storing structure transitions from the charged state to the discharged state.

C23. The assembly of paragraph C22, wherein the fluid reservoir defines an expanded state that defines an expanded internal volume and a contracted state that defines a contracted internal volume, and further wherein the expanded internal volume is greater than the contracted internal volume.

C24. The assembly of paragraph C23, wherein the fluid propulsion device includes, and optionally is, the fluid reservoir.

C25. The assembly of any of paragraphs C23-C24, wherein the fluid reservoir is configured to expel the volume of fluid from the internal volume as the fluid reservoir transitions from the expanded state to the contracted state.

C26. The assembly of any of paragraphs C23-C25, wherein the energy-storing structure is configured to provide the motive force to the fluid reservoir to transition the fluid reservoir from the expanded state to the contracted state when the energy-storing structure transitions from the charged state to the discharged state.

C27. The assembly of any of paragraphs C23-C26, wherein the downhole assembly further includes an operational linkage between the energy-storing structure and the fluid reservoir that is configured to receive the motive force from the energy-storing structure and convey the motive force to the fluid reservoir, and further wherein the fluid reservoir is configured to transition from the expanded state to the contracted state during receipt of the motive force.

C28. The assembly of any of paragraphs C23-C27, wherein the fluid reservoir defines an annular cross-sectional shape.

C29. The assembly of any of paragraphs C23-C28, wherein a first portion of the fluid reservoir is defined by a portion of a/the first section of the downhole assembly, and further wherein a second portion of the fluid reservoir is defined by a portion of a/the second section of the downhole assembly.

C30. The assembly of paragraph C29, wherein the first portion of the fluid reservoir is configured to translate relative to the second portion of the fluid reservoir when the fluid reservoir transitions between the expanded state and the contracted state.

C31. The assembly of any of paragraphs C29-C30, wherein the first portion of the fluid reservoir defines one of a piston and a cylinder, and further wherein the second portion of the fluid reservoir defines the other of the piston and the cylinder.

C32. The assembly of any of paragraphs C23-C31, wherein the fluid reservoir is configured to be transitioned from the contracted state to the expanded state when an/the tensile force is applied to a/the first section of the downhole assembly.

C33. The assembly of any of paragraphs C23-C31, wherein the fluid reservoir is configured to be transitioned from the contracted state to the expanded state when a/the compressive force is applied to a/the first section of the downhole assembly.

C34. The assembly of any of paragraphs C23-C33, wherein the fluid reservoir is configured to be repeatedly transitioned between the expanded state and the contracted state without damage to the fluid reservoir.

C35. The assembly of any of paragraphs B4-C30, wherein the fluid propulsion device includes at least one of a pump and a turbine.

C36. The assembly of any of paragraphs B4-C35, wherein the downhole assembly further includes an operational linkage that extends between the energy-storing structure and the fluid propulsion device and is configured to receive the motive force from the energy-storing structure and convey the motive force to the fluid propulsion device.

C37. The assembly of any of paragraphs B1-C36, wherein the downhole assembly further includes a/the first section that has a first cross-sectional area and a/the second section that is closer to a terminal end of the downhole assembly than the first section and that has a second cross-sectional area that is greater than the first cross-sectional area.

C38. The assembly of paragraph C37, wherein the downhole assembly further includes a transition region between the first section and the second section.

C39. The assembly of any of paragraphs C37-C38, wherein the first section includes at least one of a drill string and a drill pipe.

C40. The assembly of any of paragraphs C37-C39, wherein the first section is configured to provide fluid and mechanical communication between a surface region and the second section.

C41. The assembly of any of paragraphs C37-C40, wherein the second section includes at least one of a bottom-hole assembly, a drill string, a drill bit, and a drill collar.

C42. The assembly of any of paragraphs C37-C41, wherein the second section is configured to selectively contact a terminal end of the wellbore and produce cuttings to increase a length of the wellbore.

C43. The assembly of any of paragraphs C37-C42, wherein the first cross-sectional area is measured transverse to a longitudinal axis of the first section.

C44. The assembly of any of paragraphs C37-C43, wherein the second cross-sectional area is measured transverse to a longitudinal axis of the second section.

C45. The assembly of any of paragraphs C37-C44, wherein a ratio of the second cross-sectional area to the first cross-sectional area is at least 1.1:1, optionally including ratios of at least 1.2:1, 1.3:1, 1.4:1, 1.5:1, 1.6:1, 1.7:1, 1.8:1, 1.9:1, 2:1, 2.25:1, 2.5:1, 3:1, 4:1, or at least 5:1, and further optionally including ratios of between 1.1:1 and 2:1, between 1.5:1 and 3:1, or between 1.5:1 and 5:1.

C46. The assembly of any of paragraphs C37-C45, wherein the downhole assembly further includes a transition region between the first section and the second section.

C47. The assembly of paragraph C46, wherein the transition region operatively attaches the first section to the second section.

C48. The assembly of any of paragraphs C46-C47, wherein the fluidizing assembly is configured to emit the fluidizing stream from the downhole assembly into the wellbore proximate the transition region.

C49. The assembly of any of paragraphs B5-C48, wherein the fluidizing assembly includes at least one of a fluidizing stream discharge orifice and a diffuser.

C50. The assembly of any of paragraphs B5-C49, wherein the fluidizing assembly is proximal a/the transition region.

C51. The assembly of any of paragraphs B5-C50, wherein the fluidizing stream is configured to increase a local pressure within the portion of the cuttings bed.

C52. The assembly of any of paragraphs B5-C51, wherein the fluidizing stream is configured to decrease a solid-solid shear stress within the portion of the cuttings bed.

C53. The assembly of any of paragraphs B5-C52, wherein the downhole assembly includes an orientation control structure that is configured to selectively control an orientation of at least a portion of the fluidizing assembly to selectively provide the fluidizing stream to the portion of the cuttings bed.

C54. The assembly of any of paragraphs B5-C53, wherein the downhole assembly includes a rotary steerable system that forms a portion of the orientation control structure, and further wherein the rotary steerable system is configured to control the orientation of the at least a portion of the fluidizing assembly, and optionally wherein the fluidizing assembly is coupled to the rotary steering system.

C55. The assembly of any of paragraphs B1-C54, wherein the portion of the cuttings bed includes a portion of the cuttings bed that is within 4 meters of a/the transition region, optionally including a portion of the cuttings bed that is within 3.5 meters, within 3 meters, within 2.5 meters, within 2 meters, within 1.5 meters, within 1 meter, within 0.75 meters, within 0.5 meters, within 0.25 meters, within 0.2 meters, within 0.15 meters, within 0.1 meters, or within 0.05 meters of the transition region.

C56. The assembly of any of paragraphs B1-C55, wherein the fluidizing assembly further includes a flow control assembly that is configured to control a flow of the fluidizing stream that is emitted from the downhole assembly.

C57. The assembly of paragraph C56, wherein the flow control assembly includes at least one of an orifice and a check valve.

C58. The assembly of any of paragraphs C56-C57, wherein the flow control assembly is configured to control a flow rate of the fluidizing stream.

C59. The assembly of any of paragraphs C56-C58, wherein the flow control assembly is configured to permit the flow of the fluidizing stream from the downhole assembly into the wellbore and to resist a flow of a fluid stream from the wellbore into the downhole assembly.

C60. The assembly of any of paragraphs C1-C59, wherein the downhole assembly defines a drilling fluid conduit that extends longitudinally through a/the first section of the downhole assembly and a/the second section of the downhole assembly.

C61. The assembly of paragraph C60, wherein the drilling fluid conduit extends between a surface region and a terminal end of the downhole assembly.

C62. The assembly of any of paragraphs C60-C61, wherein the downhole assembly is in fluid communication with a drilling fluid supply system that is configured to provide a drilling fluid stream to the drilling fluid conduit.

C63. The assembly of any of paragraphs C60-C62, wherein the downhole assembly defines a/the fluid reservoir that defines at least an/the expanded state and a/the contracted state.

C64. The assembly of paragraph C63, wherein the fluid reservoir forms a portion of, and optionally is, the fluid propulsion device.

C65. The assembly of any of paragraphs C63-C64, wherein the downhole assembly further includes a fluid reservoir fill conduit that extends between the drilling fluid conduit and the fluid reservoir.

C66. The assembly of paragraph C65, wherein the fluid reservoir fill conduit includes a fill conduit flow control device that is configured to permit a fluid flow from the drilling fluid conduit into the fluid reservoir and resist a fluid flow from the fluid reservoir into the drilling fluid conduit, and optionally wherein the fill conduit flow control device includes a fill conduit check valve.

C67. The assembly of any of paragraphs C63-C66, wherein the downhole assembly further includes a fluidizing stream conduit that extends between the fluid reservoir and the fluidizing assembly, optionally wherein the fluidizing assembly defines a fluidizing stream discharge orifice that is defined by an external surface of the downhole assembly, and further optionally wherein the fluidizing assembly is located in a/the transition region between the first section of the downhole assembly and the second section of the downhole assembly.

C68. The assembly of paragraph C67, wherein the fluidizing stream conduit includes a fluidizing stream flow control device that is configured to permit a fluid flow from the fluid reservoir through the fluidizing assembly and to resist a fluid flow from the fluidizing assembly into the fluid reservoir, and optionally wherein the fluidizing stream flow control device includes a fluidizing stream conduit check valve.

C69. The assembly of any of paragraphs C67-C68, wherein the fluidizing stream includes drilling fluid that was retained, at least temporarily, in the fluid reservoir prior to being discharged from the fluid reservoir as the fluidizing stream.

C70. The assembly of any of paragraphs C67-C69, wherein the fluidizing stream discharge orifice defines an inner diameter of at least one of: (i) greater than 0.25 cm, greater than 0.5 cm, greater than 0.75 cm, greater than 1 cm, greater than 1.25 cm, greater than 1.5 cm, greater than 2 cm, and greater than 2.5 cm; and (ii) less than 5 cm, less than 4.5 cm, less than 4 cm, less than 3.5 cm, less than 3 cm, or less than 2.5 cm.

C71. The assembly of any of paragraphs C63-C70, wherein the fluid reservoir is a first fluid reservoir, wherein the downhole assembly further includes a second fluid reservoir, wherein the first fluid reservoir is configured to be transitioned from the contracted state to the expanded state when a/the tensile force is applied to a/the first section of the downhole assembly, and further wherein the second fluid reservoir is configured to be transitioned from the contracted state to the expanded state when a/the compressive force is applied to the first section of the downhole assembly.

C72. The assembly of any of paragraphs C60-C71, wherein the downhole assembly further includes a/the release mechanism that is configured to retain the energy-storing structure in the charged state and to selectively release the energy-storing structure to permit the energy-storing structure to transition to the discharged state.

C73. The assembly of any of paragraphs B1-C72, wherein the wellbore forms a portion of a hydrocarbon well.

C74. A drill rig, comprising:

the downhole assembly of any of paragraphs B1-C73;

a mechanical drive assembly that is in mechanical communication with the downhole assembly; and a/the drilling fluid supply system that is configured to supply a/the drilling fluid stream to the downhole assembly.

C75. The drill rig of paragraph C74, wherein the drill rig includes the wellbore.

C76. The drill rig of any of paragraphs C74-C75, wherein the wellbore extends within a subterranean formation that includes a hydrocarbon.

C77. The drill rig of paragraph C76, wherein the drill rig includes the subterranean formation.

D1. The use of any of the methods of any of paragraphs A1-A40 with any of the downhole assemblies of any of paragraphs B1-C73 or any of the drill rigs of any of paragraphs C74-C77.

D2. The use of any of the downhole assemblies of any of paragraphs B1-C73 or any of the drill rigs of any of paragraphs C74-C77 with any of the methods of any of paragraphs A1-A40.

D3. The use of any of the methods of any of paragraphs A1-A40, any of the downhole assemblies of any of paragraphs B1-C73, or any of the drill rigs of any of paragraphs C74-C77 to fluidize a cuttings bed.

D4. The use of any of the methods of any of paragraphs A1-A40, any of the downhole assemblies of any of paragraphs B1-C73, or any of the drill rigs of any of paragraphs C74-C77 to convey a downhole assembly within a wellbore.

D5. The use of any of the methods of any of paragraphs A1-A40, any of the downhole assemblies of any of paragraphs B1-C73, or any of the drill rigs of any of paragraphs C74-C77 to fluidize a portion of a cuttings bed.

D6. The use of a fluidizing stream to fluidize a portion of a cuttings bed.

D7. The use of an energy-storing structure to provide a motive force for emitting a fluidizing stream from a downhole assembly.

PCT1. A method of fluidizing a cuttings bed, the method comprising:

conveying a downhole assembly in a longitudinal direction within a wellbore, wherein the downhole assembly includes an energy-storing structure that defines at least a charged state and a discharged state, and further wherein the conveying includes generating an axial force within a portion of the downhole assembly;

discharging the energy-storing structure by transitioning from the charged state to the discharged state to produce a motive force, wherein the discharging is responsive to the axial force exceeding a threshold axial force;

generating a fluidizing stream with the motive force; and emitting the fluidizing stream from the downhole assembly to fluidize a portion of the cuttings bed.

PCT2. The method of paragraph PCT1, wherein, prior to the discharging, the method further includes charging the energy-storing structure by transitioning the energy-storing structure from the discharged state to the charged state, and further wherein the method includes repeating the charging and the discharging the energy-storing structure a plurality of times to emit the fluidizing stream from the downhole assembly a respective plurality of times.

PCT3. The method of any of paragraphs PCT1-PCT2, wherein the downhole assembly includes a fluid reservoir that defines at least an expanded state that defines an expanded internal volume and a contracted state that defines a contracted internal volume, wherein the expanded internal volume is greater than the contracted internal volume, and further wherein the generating includes contracting the fluid reservoir by transitioning the fluid reservoir from the expanded state to the contracted state to generate the fluidizing stream.

PCT4. The method of paragraph PCT3, wherein the method further includes applying the motive force to the fluid reservoir, wherein the contracting the fluid reservoir is responsive to receipt of the motive force by the fluid reservoir, and further wherein, prior to the contracting, the method further includes expanding the fluid reservoir by transitioning the fluid reservoir from the contracted state to the expanded state.

PCT5. The method of any of paragraphs PCT1-PCT4, wherein the downhole assembly further includes a release mechanism, wherein the release mechanism includes a passive release mechanism, and further wherein the method includes automatically initiating the discharging with the release mechanism responsive to the axial force exceeding the threshold axial force.

PCT6. The method of any of paragraphs PCT1-PCT5, wherein the downhole assembly includes a first section that has a first cross-sectional area and a second section that is closer to a terminal end of the downhole assembly than the first section and has a second cross-sectional area that is greater than the first cross-sectional area, wherein the axial force includes an axial force within the first section, and further wherein the discharging includes discharging responsive to the axial force within the first section exceeding the threshold axial force.

PCT7. A downhole assembly configured to be conveyed within a wellbore, the downhole assembly comprising:

an energy-storing structure that defines at least a charged state and a discharged state and which is configured to be discharged and generate a motive force by transitioning from the charged state to the discharged state;

a fluid propulsion device that is configured to receive the motive force from the energy-storing structure and to generate a fluidizing stream therefrom; and a fluidizing assembly that is configured to emit the fluidizing stream from the downhole assembly and provide the fluidizing stream to a cuttings bed to fluidize a portion of the cuttings bed.

PCT8. The assembly of paragraph PCT7, wherein the energy-storing structure includes at least one of a mechanical energy-storing structure, a resilient member, a spring, a chemical compound, an explosive charge, a surface assembly, a drill pipe, a captured volume of gas, and a compressed volume of gas.

PCT9. The assembly of any of paragraphs PCT7-PCT8, wherein the downhole assembly further includes a release mechanism that is configured to selectively control the transitioning of the energy-storing structure between the charged state and the discharged state, wherein the release mechanism is configured to retain the energy-storing structure in the charged state and to selectively permit the energy-storing structure to transition to the discharged state responsive to at least one of:

(i) application of a tensile force to a portion of the downhole assembly that is greater than a threshold tensile force;

(ii) application of a compressive force to the portion of the downhole assembly that is greater than a threshold compressive force; and (iii) application of an axial force to a portion of the downhole assembly that is greater than a threshold axial force.

PCT10. The assembly of any of paragraphs PCT7-PCT9, wherein the downhole assembly further includes a fluid reservoir that defines an internal volume, wherein the fluid reservoir is configured to retain a volume of fluid within the internal volume when the energy-storing structure is in the charged state and to expel the volume of fluid from the internal volume as the fluidizing stream while the energy-storing structure transitions from the charged state to the discharged state.

PCT11. The assembly of paragraph PCT10, wherein the fluid reservoir defines an expanded state that defines an expanded internal volume and a contracted state that defines a contracted internal volume, wherein the expanded internal volume is greater than the contracted internal volume, and further wherein the energy-storing structure is configured to provide the motive force to the fluid reservoir to transition the fluid reservoir from the expanded state to the contracted state when the energy-storing structure transitions from the charged state to the discharged state.

PCT12. The assembly of any of paragraphs PCT7-PCT11, wherein the downhole assembly further includes a first section that has a first cross-sectional area and a second section that is closer to a terminal end of the downhole assembly than the first section and that has a second cross-sectional area that is greater than the first cross-sectional area.

PCT13. The assembly of paragraph PCT12, wherein the first section includes at least one of a drill string and a drill pipe, and further wherein the second section includes at least one of a bottom-hole assembly, a drill string, a drill bit, and a drill collar.

PCT14. The assembly of any of paragraphs PCT7-PCT13, wherein the fluidizing assembly includes at least one of a fluidizing stream discharge orifice and a diffuser.

PCT15. The assembly of any of paragraphs PCT7-PCT14, wherein the fluidizing assembly is configured to selectively provide the fluidizing stream to a portion of the wellbore that includes the portion of the cuttings bed.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of fluidizing a cuttings bed, the method comprising:

conveying a downhole assembly in a longitudinal direction within a wellbore, wherein the downhole assembly includes an energy-storing structure that defines at least a charged state and a discharged state, and further wherein the conveying includes generating an axial force within a portion of the downhole assembly;

discharging the energy-storing structure by transitioning from the charged state to the discharged state to produce a motive force, wherein the discharging is responsive to the axial force exceeding a threshold axial force;

generating a fluidizing stream in immediate proximity to the downhole assembly with the motive force; and emitting the fluidizing stream from the downhole assembly to fluidize a portion of the cuttings bed, at least a portion of the emitted fluidizing stream oriented parallel to the generated axial force.

2. The method of claim 1, wherein, prior to the discharging, the method further includes charging the energy-storing structure by transitioning the energy-storing structure from the discharged state to the charged state.

3. The method of claim 2, wherein the method further includes repeating the charging and the discharging the energy-storing structure a plurality of times to emit the fluidizing stream from the downhole assembly a respective plurality of times.

4. The method of claim 1, wherein the downhole assembly includes a fluid reservoir that defines at least an expanded state that defines an expanded internal volume and a contracted state that defines a contracted internal volume, wherein the expanded internal volume is greater than the contracted internal volume, and further wherein the generating includes contracting the fluid reservoir by transitioning the fluid reservoir from the expanded state to the contracted state to generate the fluidizing stream.

5. The method of claim 4, wherein the method further includes applying the motive force to the fluid reservoir, and further wherein the contracting the fluid reservoir is responsive to receipt of the motive force by the fluid reservoir.

6. The method of claim 4, wherein, prior to the contracting, the method further includes expanding the fluid reservoir by transitioning the fluid reservoir from the contracted state to the expanded state.

7. The method of claim 1, wherein downhole assembly further includes a release mechanism, wherein the release mechanism includes a passive release mechanism, and further wherein the method includes automatically initiating the discharging with the release mechanism responsive to the axial force exceeding the threshold axial force.

8. The method of claim 1, wherein the downhole assembly includes a first section that has a first cross-sectional area and a second section that is closer to a terminal end of the downhole assembly than the first section and has a second cross-sectional area that is greater than the first cross-sectional area, wherein the axial force includes an axial force within the first section, and further wherein the discharging includes discharging responsive to the axial force within the first section exceeding the threshold axial force.

9. The method of claim 8, wherein the first section includes at least one of a drill string and a drill pipe, wherein the second section includes at least one of a bottom-hole assembly and a drill collar, and further wherein the discharging includes discharging responsive to the axial force within the at least one of the drill string and the drill pipe exceeding the threshold axial force.

10. A downhole assembly configured to be conveyed within a wellbore, the downhole assembly comprising:

An energy-storing structure defining at least a charged state and a discharged state in response to a discharging force generated by conveying the downhole assembly that exceeds a threshold discharging force established within the energy-saving structure, and generating a motive force by transitioning form the charged stated to the discharged state;

A fluid propulsion device that is configured to receive the motive force from the energy-storing structure and to generate a fluidizing stream therefrom; and A fluidizing assembly that is configured to emit the generated fluidizing stream from the downhole assembly along the conveyed horizontal portion of the wellbore and provide the fluidizing stream to a cuttings bed to fluidize a portion of the cuttings bed in immediate proximity to the downhole assembly.

11. The assembly of claim 10, wherein the energy-storing structure includes at least one of a mechanical energy-storing structure, a resilient member, a spring, a chemical compound, an explosive charge, a surface assembly, a drill pipe, a captured volume of gas, and a compressed volume of gas.

12. The assembly of claim 10, wherein the downhole assembly further includes a release mechanism that is configured to selectively control the transitioning of the energy-storing structure between the charged state and the discharged state.

13. The assembly of claim 12, wherein the release mechanism is configured to retain the energy-storing structure in the charged state and to selectively permit the energy-storing structure to transition to the discharged state responsive to at least one of: (i) application of a tensile force to a portion of the downhole assembly that is greater than a threshold tensile force; (ii) application of a compressive force to the portion of the downhole assembly that is greater than a threshold compressive force; and (iii) application of an axial force to a portion of the downhole assembly that is greater than a threshold axial force.

14. The assembly of claim 10, wherein the downhole assembly further includes a fluid reservoir that defines an internal volume, wherein the fluid reservoir is configured to retain a volume of fluid within the internal volume when the energy-storing structure is in the charged state and to expel the volume of fluid from the internal volume as the fluidizing stream while the energy-storing structure transitions from the charged state to the discharged state.

15. The assembly of claim 14, wherein the energy-storing structure is configured to provide the motive force to the fluid reservoir to transition the fluid reservoir from the expanded state to the contracted state when the energy-storing structure transitions from the charged state to the discharged state.

16. The assembly of claim 10, wherein the downhole assembly further includes a first section that has a first cross-sectional area and a second section that is closer to a terminal end of the downhole assembly than the first section and that has a second cross-sectional area that is greater than the first cross-sectional area.

17. The assembly of claim 16, wherein the first section includes at least one of a drill string and a drill pipe, and further wherein the second section includes at least one of a bottom-hole assembly, a drill string, a drill bit, and a drill collar.

18. The assembly of claim 10, wherein the fluidizing assembly includes at least one of a fluidizing stream discharge orifice and a diffuser.

19. The assembly of claim 10, wherein the fluidizing assembly is configured to selectively provide the fluidizing stream to a portion of the wellbore that includes the portion of the cuttings bed.

* * * * *